US007791546B2

(12) United States Patent
Hotta et al.

(10) Patent No.: US 7,791,546 B2
(45) Date of Patent: Sep. 7, 2010

(54) ANTENNA DEVICE AND ELECTRONIC APPARATUS

(75) Inventors: Hiroyuki Hotta, Hamura (JP); Koichi Sato, Tachikawa (JP); Hiroshi Shimasaki, Kunitachi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 61 days.

(21) Appl. No.: 12/188,923

(22) Filed: Aug. 8, 2008

(65) Prior Publication Data

US 2009/0079639 A1 Mar. 26, 2009

(30) Foreign Application Priority Data

Sep. 21, 2007 (JP) ..... 2007-245205

(51) Int. Cl.
*H01Q 1/24* (2006.01)

(52) U.S. Cl. ..... 343/702; 343/700 MS

(58) Field of Classification Search ..... 343/700 MS, 343/702, 895
See application file for complete search history.

(56) References Cited

U.S. PATENT DOCUMENTS

| | | | | |
|---|---|---|---|---|
| 5,821,902 | A | 10/1998 | Keen | |
| 5,929,825 | A * | 7/1999 | Niu et al. | 343/895 |
| 6,307,520 | B1 | 10/2001 | Liu | |
| 6,819,287 | B2 * | 11/2004 | Sullivan et al. | 343/700 MS |
| 6,961,028 | B2 | 11/2005 | Joy et al. | |
| 7,345,637 | B2 | 3/2008 | Mizoguchi et al. | |
| 7,423,598 | B2 * | 9/2008 | Bit-Babik et al. | 343/702 |
| 7,605,764 | B2 * | 10/2009 | Ishimiya | 343/702 |
| 2004/0137950 | A1 | 7/2004 | Bolin | |
| 2007/0115118 | A1 | 5/2007 | Hsu et al. | |
| 2007/0115188 | A1 | 5/2007 | Mizoguchi et al. | |

FOREIGN PATENT DOCUMENTS

| | | |
|---|---|---|
| EP | 1 555 715 | 7/2005 |
| EP | 1 679 762 | 7/2006 |
| JP | 8-046419 | 2/1996 |
| JP | 2004-172912 | 6/2004 |
| JP | 2004-173143 | 6/2004 |
| JP | 2004-260586 | 9/2004 |

(Continued)

OTHER PUBLICATIONS

European Search Report dated Feb. 10, 2009 for application No. 08161655.9 (U.S. Appl. No. 12/188,923), entitled Antenna Device and Electronic Apparatus.

(Continued)

*Primary Examiner*—Tan Ho
(74) *Attorney, Agent, or Firm*—Blakely, Sokoloff, Taylor & Zafman LLP

(57) ABSTRACT

According to one embodiment, an antenna device includes a folded element and an end-free element wound around a core member. A feed potion for a folded element and an end-free element is located close to one end of the core member, and a ground portion for a folded element is located closer to the one end than the feed portion. A coaxial cable connected to the feed portion is led away the antenna device, and an external conductor of the coaxial cable is connected near the ground portion.

20 Claims, 17 Drawing Sheets

FOREIGN PATENT DOCUMENTS

| | | |
|---|---|---|
| JP | 2006-246070 | 9/2006 |
| JP | 2007-088975 | 4/2007 |
| JP | 2007-129597 | 5/2007 |
| JP | 2007-142895 | 6/2007 |

OTHER PUBLICATIONS

Japanese Patent Application No. 2007-245205, Notice of Reasons for Rejection, mailed Feb. 2, 2010 (English translation).

Japanese Patent Application No. 2007-245205, Decision of Rejection, mailed Jun. 15, 2010 (English translation).

* cited by examiner

ANTENNA DEVICE AND ELECTRONIC APPARATUS

CROSS-REFERENCE TO RELATED APPLICATIONS

This application is based upon and claims the benefit of priority from Japanese Patent Application No. 2007-245205, filed Sep. 21, 2007, the entire contents of which are incorporated herein by reference.

BACKGROUND

1. Field

One embodiment of the present invention relates to an antenna device and an electronic apparatus incorporating the antenna device in its housing. More particularly, it relates to an antenna device of a type incorporated in the peripheral portion of the display panel of, for example, a notebook personal computer.

2. Description of the Related Art

A conventional antenna device incorporated in a radio communication apparatus, such as a portable telephone, is disclosed by, for example, Jpn. Pat. Appln. KOKAI Publication No. 2007-88975. The antenna device has a structure that comprises a first antenna element formed as a folded monopole antenna, and a second antenna element formed as a monopole antenna and extending from the middle portion of the first antenna element. The first antenna element includes, a short-circuiting portion for independently controlling the resonance frequency of the first antenna element and that of the second antenna element. The antenna device is directly attached to a substrate, incorporated in the radio communication apparatus, by connecting the feed portion of the first antenna element (and hence the feed portion of the second antenna element) to that of the substrate, and connecting the grounding point of the first antenna element to the grounding area of the substrate.

Further, in notebook personal computers, an antenna device is generally contained in the housing near the periphery of the display panel. For instance, when an antenna device of the above-described type is attached to a notebook personal computer, a coaxial cable for power feeding is connected to the feed portion of the first antenna element of the antenna device. At this time, the internal conductor of the coaxial cable is connected to the feed portion, and the external conductor of the coaxial cable is grounded.

However, since in the above-described antenna device, the feed portion is located at an end of the device, it is necessary to provide a contact, which is used to ground the external conductor of the coaxial cable, outside the above-mentioned end, in order to lead the coaxial cable away from the end in consideration of variations in antenna characteristics. This necessity inevitably increases the required space of the antenna device.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments and their modifications according to the invention will be described with reference to the accompanying drawings. In general, according to one embodiment of the invention, an antenna device operates at a first resonance frequency and a second resonance frequency. The antenna device comprises a folded element that includes an approach route portion extending from a feed portion to a folded portion via at least one angled portion, a return route portion extending from the folded portion to a ground portion in substantially parallel with the approach route portion, and a short-circuiting portion short-circuiting the approach and return route portions. The length of a route ranging from the feed portion to the ground portion via the folded portion is substantially equal to half a wavelength corresponding to the first resonance frequency. The distance between the feed portion and the ground portion is substantially not more than one fifth of the wavelength corresponding to the first resonance frequency. The antenna device also comprises an end-free element branching from the folded element between the feed portion and the angled portion. The end-free element includes a free end. The length of a route ranging from the feed portion to the free end via a branching portion is substantially equal to one quarter of a wavelength corresponding to the second resonance frequency. The feed portion is located close to one end of the antenna device, and the ground portion is located closer to the one end than the feed portion.

Figure 1:
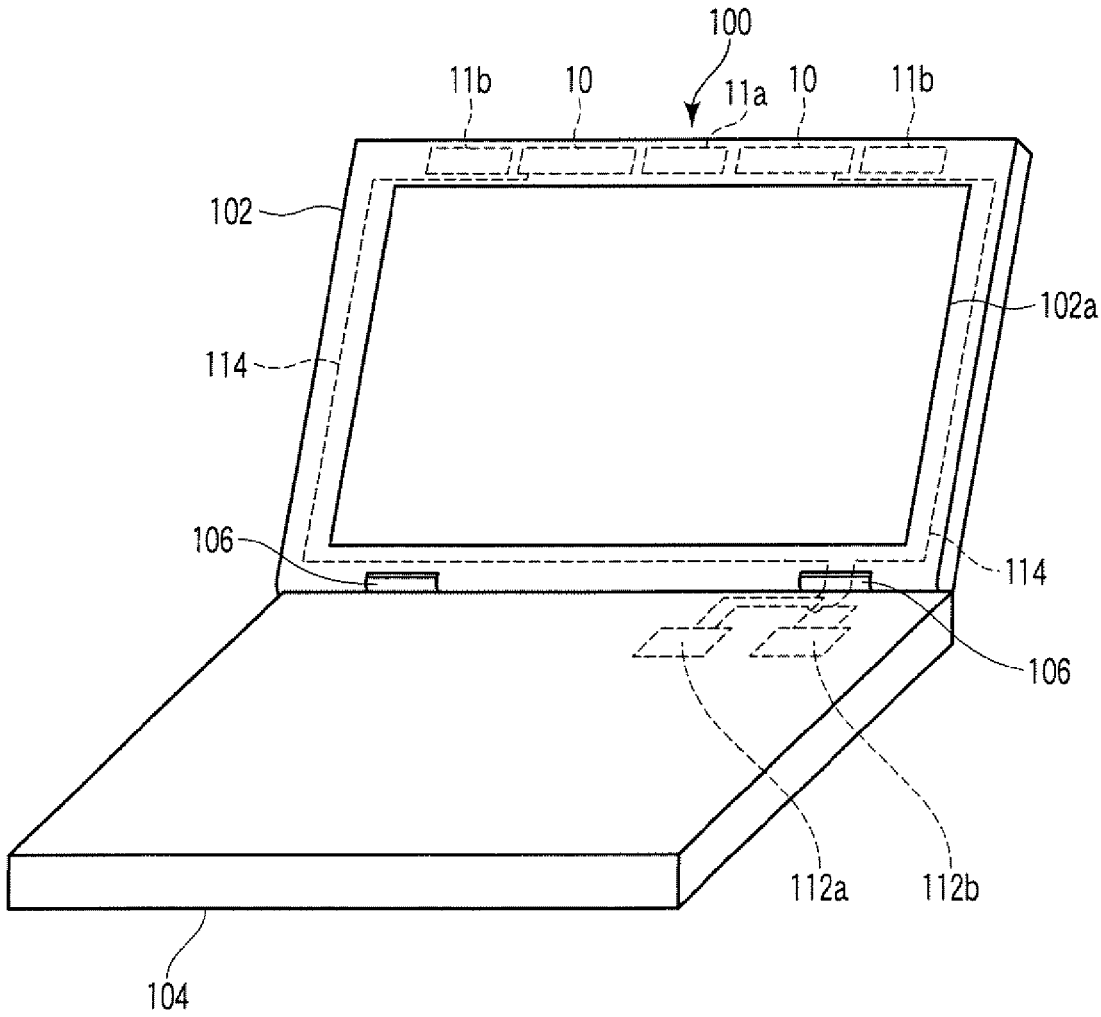
FIG. 1 is a schematic perspective view illustrating a notebook PC that incorporates an antenna device according to the invention.

FIG. 1 is a schematic perspective view illustrating a notebook personal computer (PC) 100 as an electronic apparatus that incorporates an antenna device 10 according to a first embodiment of the invention. The antenna device 10 can be incorporated in other electronic apparatuses having a radio communication function, as well as in the notebook PC 100.

As shown in FIG. 1, the notebook PC 100 comprises a display unit (display housing) 102 and main unit 104. The display unit 102 and main unit 104 are coupled in an operable and closable manner by two hinges 106. In a tablet-type notebook PC, the display unit 102 and main unit 104 are coupled by a single hinge.

The display unit 102 includes a liquid crystal panel 102*a*, and a plurality of antenna devices 10, 11*a* and 11*b*, described later in detail, provided near the end portion of the liquid crystal panel 102*a* (that is, at the peripheral portion of the display unit 102). The antenna devices 10, 11*a* and 11*b* are contained in the housing of the display unit 102. More specifically, two antenna devices 10 according to the invention, and other three antenna devices 11*a* and 11*b*, i.e., five antenna devices in total are alternately arranged along the end of the liquid crystal panel 102*a* in the order illustrated. The other antenna devices 11*a* and 11*b* are dedicated to, for example, Bluetooth (trademark) or wireless LAN.

The main unit 104 includes wireless communication modules 112*a* and 112*b* that correspond to the respective antenna devices 10 and serve as feeding circuits for generating high frequency signals corresponding to transmission signals in the form of electromagnetic waves. Radio communication modules connected to the other antenna devices 11*a* and 11*b* are not shown or described. The modules 112*a* and 112*b* are connected to each of the antenna devices 10 via feed cables 114 that pass one of the hinges 106. Since the antenna devices 10 of the first embodiment operate at least at first and second resonance frequencies as described later, they are each connected to both modules 112*a* and 112*b*. The feed cables 114 are coaxial cables.

Figure 2:
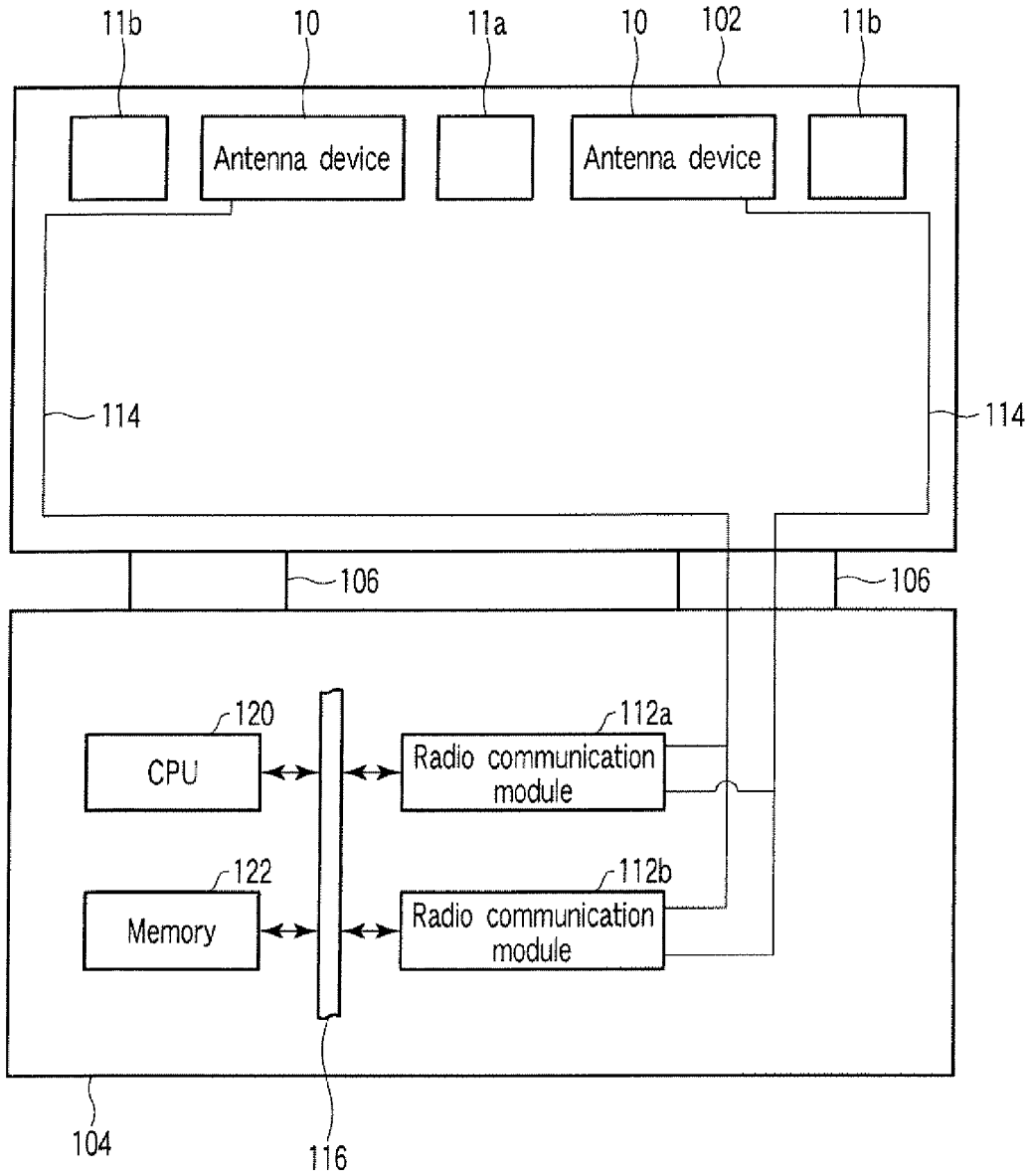
FIG. 2 is a block diagram illustrating the circuitry of the notebook PC shown in FIG. 1.

FIG. 2 shows the circuitry of the above-mentioned notebook PC 100. FIG. 2 also does not show the antenna device 11*a* or 11*b*, or a radio module connected thereto. Further, no description is given of them. The radio communication modules 112*a* and 112*b* are connected to a CPU 120 and memory 122 via a CPU bus 116. The radio communication modules 112*a* and 112*b* each include a radio frequency (RF) section, quartz oscillation section and baseband processing section, which are not shown.

Figure 3:
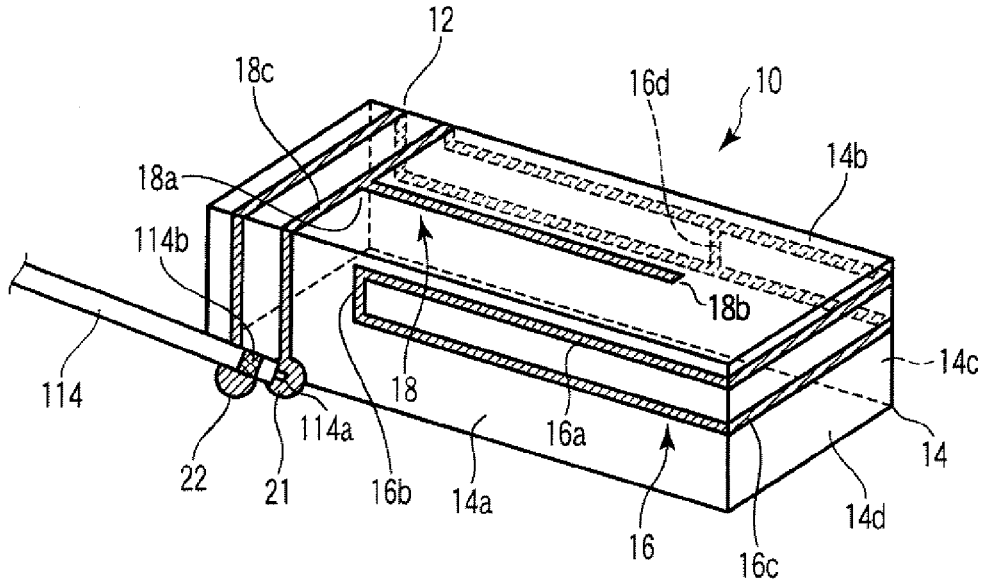
FIG. 3 is a schematic perspective view illustrating an antenna device according to a first embodiment of the invention.
Figure 4:
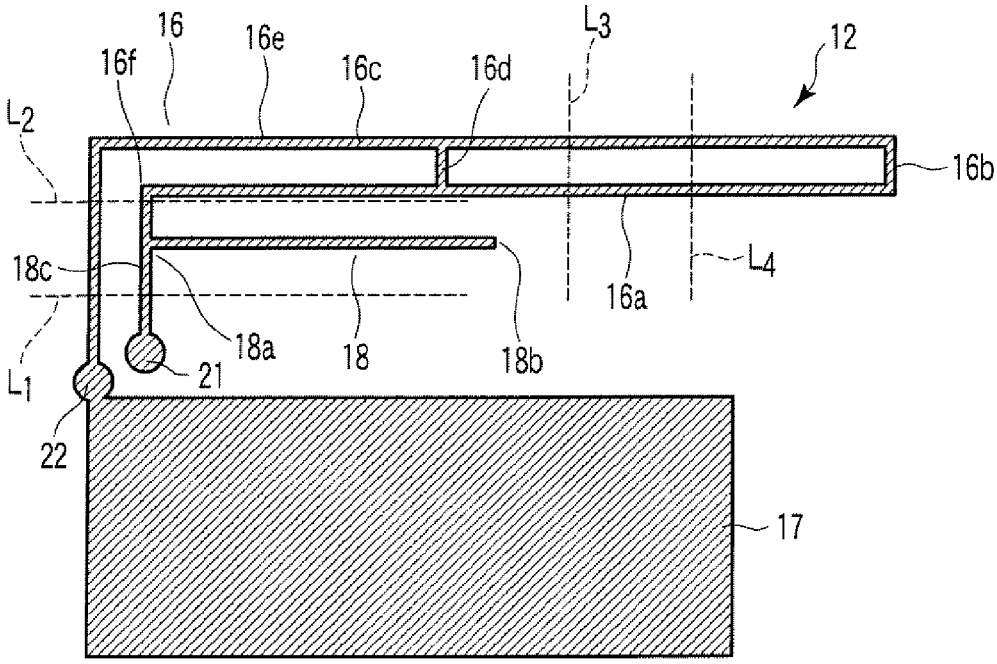
FIG. 4 is a development view of the antenna pattern of the antenna device shown in FIG. 3.

FIG. 3 is a schematic perspective view illustrating each antenna device 10. FIG. 4 is a development view illustrating an antenna pattern 12 and an antenna ground 17 (hereinafter referred to simply as the "ground 17"), which are incorporated in each antenna device 10. As shown in FIG. 3, each antenna device 10 comprises a substantially rectangular core member 14 formed of a dielectric material, and an antenna pattern 12 wound around the core member 14 and also shown in the development view of FIG. 4. Each antenna device 10 of the first embodiment operates at least at each of the first and second resonance frequencies.

More specifically, in each antenna device 10, a feed portion 21 as the initial end of the antenna pattern is located close to a lengthwise end of the antenna device 10 and connected to an internal conductor 114*a* provided in the above-described coaxial cable 114.

As shown in FIG. 3, the coaxial cable 114 is led from the feed portion 21 located close to one end of the antenna device 10, and is extended along the long side of the antenna device 10 away from the same. The external conductor 114*b* of the coaxial cable 114 is grounded via a ground portion 22 that is incorporated in the antenna pattern 12 and located adjacent to the feed portion 21, as will be described later.

The core member 14 includes a first surface 14*a* on which the feed portion 21 is provided, a second surface 14*b* on which the free end 18*b* of an end-free element 18, described later, is provided, a third surface 14*c* on which a short-circuiting portion 16*d* incorporated in a folded element 16, described later, is provided, and a fourth surface 14*d* as another end of the antenna device 10 located away from the feed portion 21 and substantially perpendicular to the first to third surfaces 14*a* to 14*c*. Namely, the third surface 14*c* opposes the first surface 14*a*, and the second surface 14*b* bridges the first and third surfaces 14*a* and 14*c* and is substantially perpendicular to the first and third surfaces 14*a* and 14*c*.

The antenna pattern 12 includes the above-mentioned a folded element 16 and an end-free element 18, both of which extend from the feed portion 21 on the first surface 14*a* of the core member 14. The ground 17 is connected to a folded element 16 and an end-free element 18 via the ground portion 22 and is electrically connected to the housing of the display unit 102.

When the housing of the display unit 102 is formed of, for example, a material containing magnesium, the ground 17 is attached to the housing by an aluminum tape. Further, when the housing of the display unit 102 is formed of plastic, the ground 17 is attached by an aluminum tape to a plated conductive portion provided at the reverse side of the liquid crystal panel 102*a*.

A folded element 16 includes an approach route portion 16*a* extending from the feed portion 21 to a folded portion 16*b*, a return route portion 16*c* extending from the folded portion 16*b* to the ground portion 22, and a short-circuiting portion 16*d* short-circuiting the approach and return route portions 16*a* and 16*c*. The folded element 16, also includes an angled portion 16*f*, is bent by substantially 90° and extended on the third surface 14*c* toward the fourth surface 14*d*. Although in the first embodiment, the approach route portion 16*a* includes one angled portion 16*f*, it may include two or more angled portions.

An end-free element 18 branches at a branching portion 18*a* from the approach route portion 16*a* between the feed portion 21 and angled portion 16*f*, and extends on the second surface 14*b* along a long side thereof. An end-free element 18 includes a free end 18*b* remote from the branching portion 18*a*. Namely, the approach route portion 16*a* ranging from the feed portion 21 to the branching portion 18*a* serves as a common portion 18*c* included in common in a folded element 16 and an end-free element 18.

More specifically, the approach route portion 16*a* of a folded element 16 is extended from the feed portion 21 over the first and second surfaces 14*a* and 14*b* along their short sides, then bent through substantially 90° at the angled portion 16*f* on the third surface 14*c*, and extended along the long sides of the third surface 14*c* and fourth surface 14*d* to the folded portion 16*b* on the first surface 14*a*.

The return route portion 16*c* of the first antenna 16 is extended from the folded portion 16*b* in substantially parallel with the approach route portion 16*a*, further extended over the first surface 14*a*, fourth surface 14*d*, third surface 14*c*, second surface 14*b* and first surface 14*a* in this order, and is terminated at the ground portion 22. In FIG. 4, the return route portion 16*c* is located outside the approach route portion 16*a*.

In an end-free element 18, the common portion 18*c* between the feed portion 21 and branching portion 18*a* is extended from the first surface 14*a* of the core member 14 to the second surface 14*b*, and extended from the branching portion 18*a* to the free end 18*b* on the second surface 14*b*. The branching portion 18*a* and free end 18*b* are located on the second surface 14*b* of the core member 14.

Namely, the antenna pattern 12 is bent at substantially right angles in appropriate directions at the positions indicated by broken lines L1, L2, L3 and L4 of FIG. 4, so that it is wound around the core member 14. The antenna pattern 12 may be formed as a metal member different from the core member 14. Alternatively, the antenna pattern 12 may be formed by printing it on a flexible printed circuit board along with the ground 17, and then bending the board at the positions indicated by broken lines L1, L2, L3 and L4 of FIG. 4.

In any case, when the antenna device 10 constructed as above is incorporated in the notebook PC 100, the internal conductor 114*a* of the coaxial cable 114 is connected to the feed portion 21, and the coaxial cable 114 is led from the feed portion 21 toward the ground portion 22. At this time, since the ground portion 22 is located outside the feed portion 21, the coaxial cable 114 passes above the ground portion 22 as shown in FIG. 3. Namely, in the first embodiment, since the coaxial cable 114 is led from the feed portion 21 toward the ground portion 22, the external conductor 114*b* of the coaxial cable 114 can be easily connected to the ground portion 22. The connection of the external conductor 114*b* is performed by, for example, soldering.

As described above, in the first embodiment, the coaxial cable 114 connected to the antenna pattern 12 for power feeding is led so that it does not pass near the antenna device 10 as far as possible. This can suppress the influence of variations in the route of the coaxial cable 114 upon the characteristics of the antenna device 10. Further, in the first embodiment, it is not necessary to provide, outside the antenna device 10, a particular ground terminal dedicated to grounding the external conductor 114*b* of the coaxial cable 114 as a feed cable, since the ground portion 22 of the antenna pattern 12 can be also used as that of the feed cable 114.

Thus, the ground portion for the feed cable 114 can be provided within the entire length of the antenna device 10, without changing the size of the device 10, thereby reducing the space required for installing the antenna device 10. For instance, when a plurality of antenna devices 10, 11*a* and 11*b* are arranged along the end of the liquid crystal panel 102*a* of the notebook PC 100 as in the first embodiment, it is advantageous to reduce the width of each antenna device.

Figure 5:
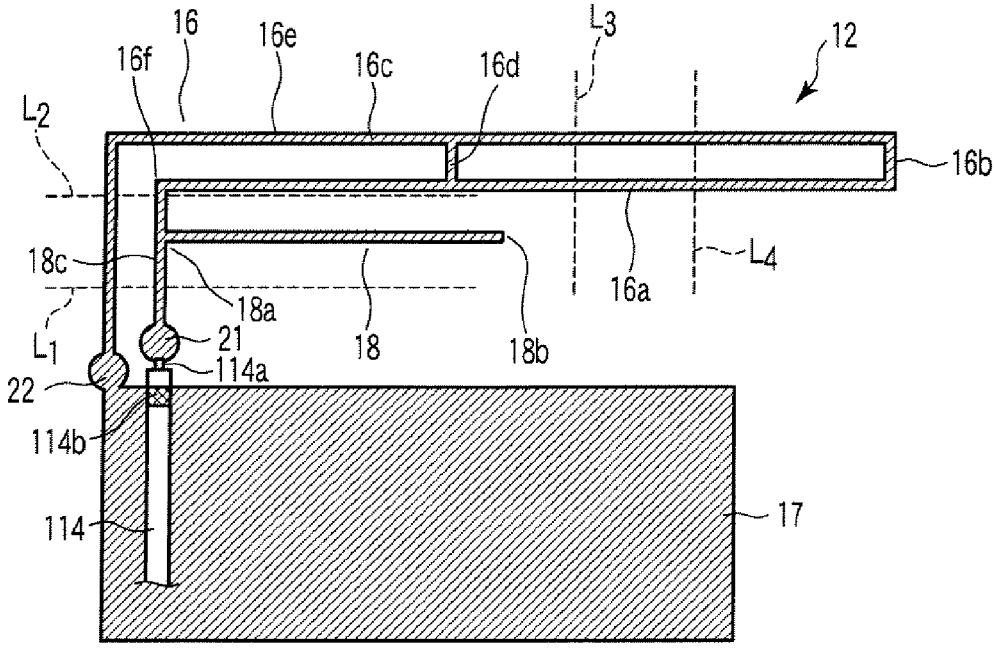
FIG. 5 is a development view illustrating the antenna pattern of a modification of the antenna device shown in FIG. 3, in which the orientation of extension of a coaxial cable included in the antenna device is changed.

Further, in the first embodiment, the coaxial cable 114 can be downwardly led from the feed portion 21 in FIG. 3, without changing the shape of the device. In this case, for example, the external conductor 114*b* of the coaxial cable 114 is soldered to the ground 17 located just below the feed portion 21, as is shown in the development view of FIG. 5. Thus, the degree of freedom in the leading direction of the coaxial cable 114 is high.

A description will now be given of the relationship between the two resonance frequencies of the above-described antenna device 10 and the lengths of a folded element 16 and an end-free element 18.

The entire length of a folded element 16, i.e., the sum of the approach route 16*a* extending from the feed portion 21 to the folded portion 16*b*, and the return route 16*c* extending from the folded portion 16*b* to the ground portion 22, is substantially equal to half the wavelength corresponding to the first resonance frequency at which the antenna device 10 operates. Further, the distance between the feed portion 21 and ground portion 22 of the first antenna 16 is set to a value not more than substantially one fifth of the first resonance frequency.

By constructing a folded element 16 as above, it can be used as a folded monopole antenna. Note that it is experimentally known that it is necessary to set the upper limit of the distance between the feed portion 21 and ground portion 22 to a value not more than substantially one fifth of the wavelength corresponding to the first resonance frequency in order to enable the first antenna 16 to effectively serve as a folded monopole antenna that operates at the first resonance frequency.

The length of an end-free element 18 ranging from the feed portion 21 to the free end 18*b* via the branching portion 18*a* is substantially equal to one quarter of the wavelength corresponding to the second resonance frequency at which the antenna device 10 operates. By thus setting the length of an end-free element 18, an end-free element 18 can serve as a monopole antenna with a free end.

Further, the length of the short-circuited route 16*e* ranging from the feed portion 21 to the ground portion 22 via the approach route 16*a*, short-circuiting portion 16*d* and return route 16*c* of a folded element 16 is set to substantially equal to half of the wavelength corresponding to the second resonance frequency. In other words, the impedance of an end-free element 18 can be adjusted by adjusting the position of the short-circuiting portion 16*d* of a folded element 16, thereby realizing impedance matching.

The above-mentioned correspondence between the resonance frequency and the length of the antenna is also applied to antenna devices according to other embodiments described below. Further, in the following embodiments, elements similar to those described in the first embodiment are denoted by corresponding reference numbers, and no detailed description may be given thereof.

Figure 6:
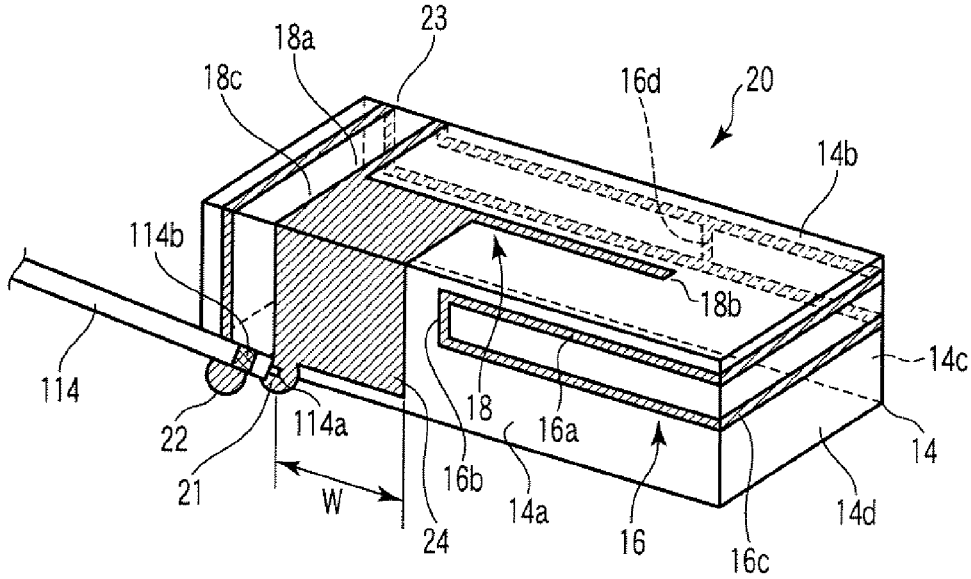
FIG. 6 is a schematic perspective view illustrating an antenna device according to a second embodiment of the invention.
Figure 7:
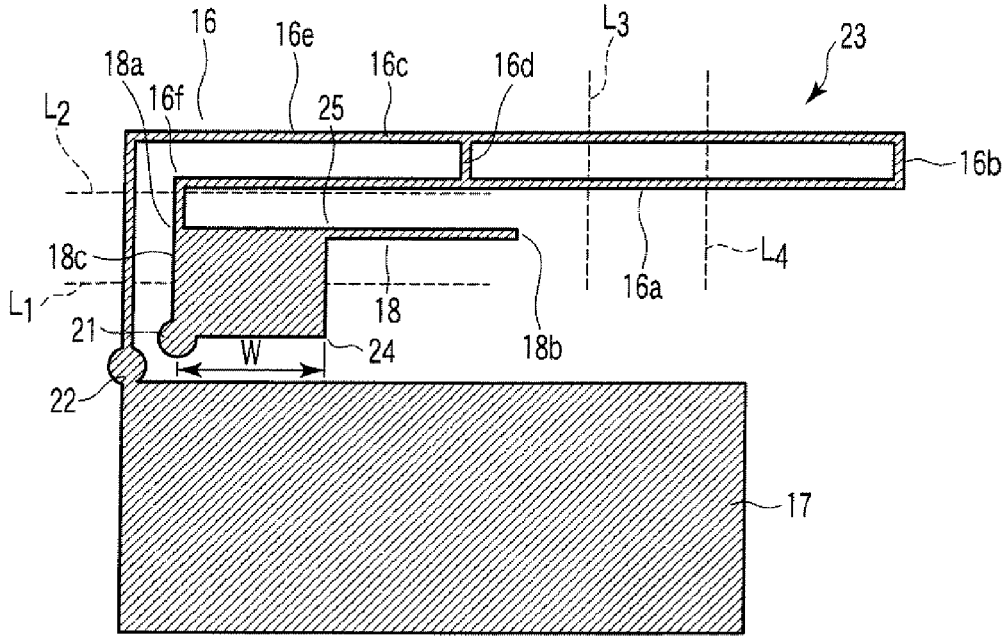
FIG. 7 is a development view of the antenna pattern of the antenna device shown in FIG. 6.

FIG. 6 is a schematic perspective view illustrating an antenna device 20 according to a second embodiment of the invention. FIG. 7 is a development view of the antenna pattern 23 of the antenna device 20. The antenna device 20 of the second embodiment has the same structure as the antenna device 10 of the first embodiment except that in the former, the common portion 18*c* of the antenna pattern 23 extending from the feed portion 21 is extended toward the free end 18*b* to form a substantially rectangular portion 24 (feed-side partial element). Therefore, elements similar to those described in the first embodiment are denoted by corresponding reference numbers, and no detailed description will be given thereof.

The rectangular portion 24 is formed integral with the antenna pattern 23 by extending the common portion 18*c* toward the free end 18*b* of an end-free element 18 over the first and second surfaces 14*a* and 14*b* of the core member 14. As a result, the rectangular portion 24 has a width W as shown in FIG. 6. The feed portion 21 is connected to a corner of the rectangular portion 24, i.e., to the corner of the portion 24 close to one side of the antenna device 20. Further, the ground portion 22 is provided closer than the feed portion 21 to the one side of the antenna device 20, as in the first embodiment.

Accordingly, in the second embodiment, the coaxial cable 114 connected to the feed portion 21 is led therefrom to a position away from the core member 14 via the ground portion 22, as in the first embodiment. Thus, the external conductor 114*b* of the coaxial cable 114 can be easily connected to the ground portion 22. Namely, also in the antenna device 20 of the second embodiment, the space for installing the device can be reduced without causing variations in antenna characteristics.

Figure 8:
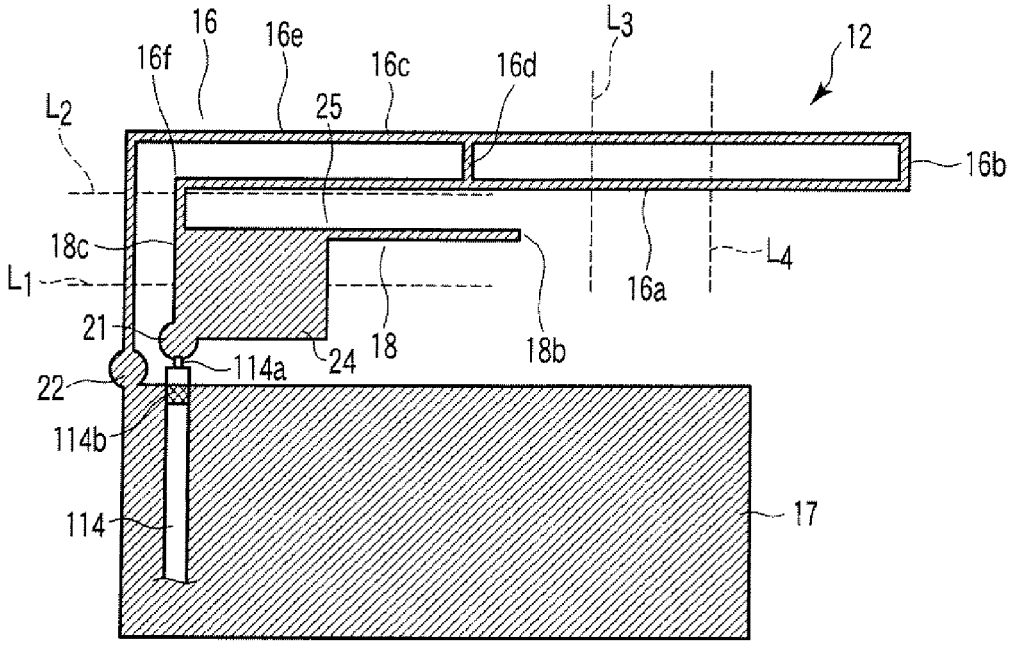
FIG. 8 is a development view illustrating the antenna pattern of a modification of the antenna device shown in FIG. 6, in which the orientation of extension of a coaxial cable included in the antenna device is changed.

Further, the coaxial cable 114 can also be downwardly led from the feed portion 21, without changing the shape of each element of the antenna device 20, as is shown in FIG. 8. Thus, the antenna device can be designed with a high degree of freedom in the lead-out direction of the coaxial cable 114. In the case of downwardly leading out the coaxial cable 114, the external conductor 114*b* of the coaxial cable 114 is soldered to the ground 17 located just below the feed portion 21, as shown in FIG. 8.

The advantage of the rectangular portion 24 will now be described.

In the case of, for example, the antenna device 10 of the first embodiment with no rectangular portion, when the difference between the first and second resonance frequencies is relatively large, if the short-circuiting portion 16*d* is located close to the feed portion 21 or ground portion 22, inductivity of the impedance of the antenna device 10 increases at the first resonance frequency, thereby losing the impedance matching of the antenna device 10 at the first resonance frequency. Namely, in this case, it is difficult to achieve impedance matching independently at the first and second resonance frequencies, the difference of which is relatively large.

In contrast, in the antenna device 20 of the second embodiment, since the antenna pattern 23 has the rectangular portion 24 obtained by increasing the width of the common portion 18*c*, an allowance is imparted to the impedance viewed from the feed portion 21 at the first resonance frequency, thereby offsetting the conductivity of the impedance of the antenna device 20 increases when the width of the common portion 18*c* increases. Accordingly, in the antenna device 20 of the second embodiment, even if the difference between the first and second resonance frequencies is relatively large, independent impedance adjustment can be easily achieved.

Further, in the second embodiment incorporating the wide rectangular portion 24, a wide resonance frequency band can be obtained in a frequency band higher than the second resonance frequency, compared to the structure with no rectangular portion 24. This will be described later in detail, referring to simulation results obtained by a moment method.

In addition, the conditions stated below are imparted to the rectangular portion 24 to enable the antenna device 20 to operate at third and fourth resonance frequencies that differ from the above-described first and second resonance frequencies.

Firstly, in FIG. 7 or 8, the route ranging from the feed portion 21 to a branching portion 25 along the lower and right-hand ends of the rectangular portion 24, which does not pass the branching portion 18*a* but passes the lower right corner of the rectangular portion 24, has a length substantially equal to one quarter of the wavelength corresponding to the third resonance frequency. The branching portion 25 is located away from the branching portion 18 toward the free end 18*b* by the width W.

Secondly, the distance between the rectangular portion 24 and the ground 17 is set to a value equal to 1/20 or less of the wavelength corresponding to the third resonance frequency. Thirdly, the width W of the rectangular portion 24 is set to a value substantially equal to one quarter of the wavelength corresponding to the fourth resonance frequency.

Figure 9:
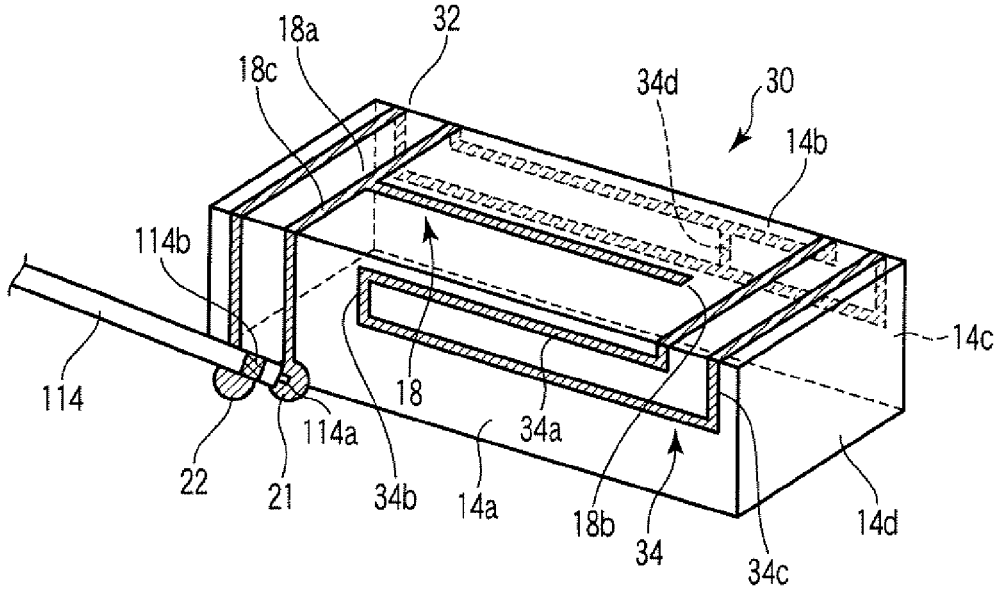
FIG. 9 is a schematic perspective view illustrating an antenna device according to a third embodiment of the invention.
Figure 10:
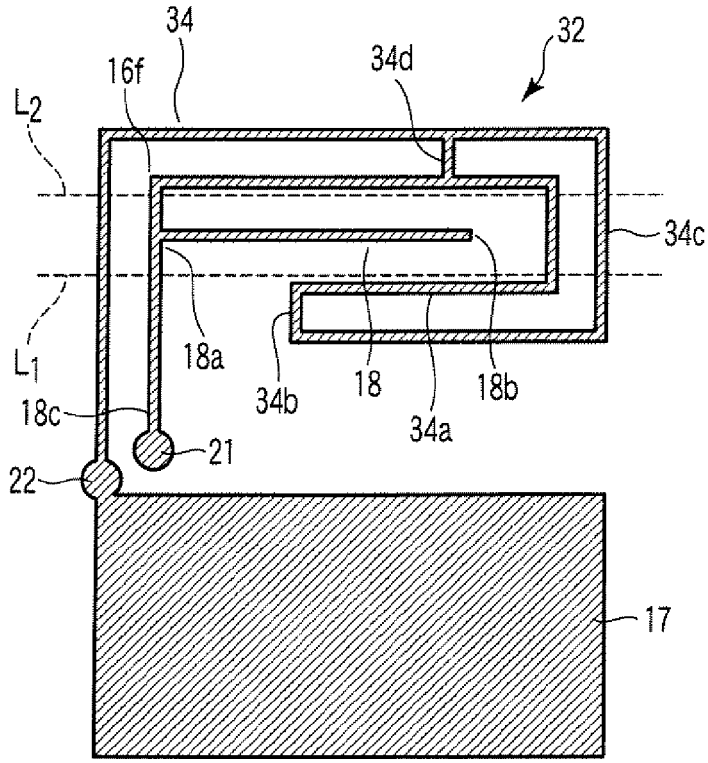
FIG. 10 is a development view of the antenna pattern of the antenna device shown in FIG. 9.

FIG. 9 is a schematic perspective view illustrating an antenna device 30 according to a third embodiment of the invention, in which the routing of an antenna pattern 32 is made different from that of the antenna pattern 12 of the antenna device 10 shown in FIG. 3. FIG. 10 is a development view of the antenna pattern 32 of the antenna device 30. Since the antenna device 30 has the same structure as the antenna device 10 of the first embodiment except that the routing of the antenna pattern differs therebetween, elements of the former similar to those of the latter are denoted by corresponding reference numbers, and no detailed description will be given thereof.

A folded element 34 included in the antenna pattern 32 is extended on the first, second and third surfaces 14*a*, 14*b* and 14*c* of the core member 14, but is not extended on the fourth surface 14*d* of the same. Further, as can be seen from the development view of FIG. 10, a folded element 34 is angled at several points to surround the free end 18*b* of an end-free element 18. Also in the third embodiment, the feed portion 21 of a folded element 34 is located close to an end of the antenna device 30, and the ground portion 22 is located yet closer to the end of the device 30.

Accordingly, in the third embodiment, the coaxial cable 114 connected to the feed portion 21 can be led from the end of the antennae device 30 toward a position away from the same and the external conductor 114*b* of the coaxial cable 114 can be easily connected to the ground portion 22, as in the first embodiment. Namely, also in the antenna device 30 of the third embodiment, the coaxial cable 114 can be routed away from the antenna device 30 as far as possible, thereby suppressing variations in the characteristics of the antenna device 30, and reducing the space required for installing the antenna device 30.

Referring now to both FIGS. 9 and 10, the routing of a folded element 34 will be described in more detail. The approach route portion 34*a* of a folded element 34 is extended from the feed portion 21 on the first surface 14*a* of the core member 14 along a short side of the first surface 14*a*, then passed through the branching portion 18*a* on the second surface 14*b*, bent at the angled portion 16*f* on the third surface 14*c* to extend on the third surface 14*c* in parallel with the second antenna 18, then again bent, to the second surface 14*b*, from a position on the third surface 14*c* close to an end thereof remote from the feed portion 21, further bent from the second surface 14*b* to the first surface 14*a*, and then extended in parallel with the second antenna 18. Thus, the approach route portion 34*a* substantially surrounds the free end 18*b* of the second antenna 18.

The return route portion 34*c* of a folded element 34 connected to the approach route portion 34*a* via a folded portion 34*b* is angled at several points along the approach route portion 34*a* outside thereof. Thus, the return route portion 34*c* is extended to the ground portion 22 in substantially parallel with the approach route portion 34*a*. Further, the approach route portion 34*a* and return route portion 34*c* are short-circuited by a short-circuiting portion 34*d*.

When a folded element 34 is routed as above, the antenna pattern 32 can be wound around the core member 14 as shown in FIG. 9, simply by bending the cable at substantially right angles in the same direction along two broken lines L1 and L2 of FIG. 10. Namely, in the third embodiment, it is not necessary to bend a folded element 34 at four positions, unlike the antenna pattern shown in FIG. 4. Thus, it is sufficient if the antenna pattern 32 is bent twice, thereby reducing the number of required steps of manufacturing the antenna device 30 and hence reducing the manufacturing cost of the same.

Alternatively, the antenna pattern 32 may be extended on only the first and second surfaces 14*a* and 14*b* of the core member 14. In this case, the antenna device 30 can be formed simply by bending the antenna pattern 32, for example, only one time at the position L1, thereby further reducing the number of manufacturing steps for the antenna device 30 and hence the manufacturing cost of the same. Namely, in this case, the short-circuiting portion 34*b* of the first antenna 34 and the free end 18*b* of the second antenna 18 are provided on the second surface 14*b* of the core member 14.

Furthermore, in the third embodiment, as is evident from FIG. 10, a folded element 34 is angled a larger number of times and hence made more compact in layout than the first antenna 12 of FIG. 4. This being so, the mold for forming the antenna pattern 32 of FIG. 10 can be made much more shorter in length than the mold for forming the antenna pattern 12 of FIG. 4, although the former is greater in width than the latter. In other words, the mold for forming the antenna pattern 32 can be made such that the difference between the length and width is smaller than in the case of the mold for forming the antenna pattern 12. This means that the mold for forming the antenna pattern 32 can be made more easily, and further a large number of antenna pattern 32 can be more easily formed from a single plate. Accordingly, the manufacturing cost of the antenna device 30 can be reduced.

The antenna pattern 32 may be formed by processing metal foil, or by printing, on a flexible wiring board, the antenna pattern 32 and at least part of the ground 17, which are patterned as shown in FIG. 10. In the latter case, it is sufficient if substantially rectangular areas with a large number of antenna pattern 32 (and grounds 17) printed thereon are cut out of a flexible printed board, and each rectangular area is bent at the above-mentioned two positions L1 and L2 in the same direction. As a result, each antenna pattern 32 can be easily wound around a core member 14. Thus, the antenna device 30 can be easily produced, and the yield of material can be enhanced, thereby further reducing the manufacturing cost.

Figure 11:
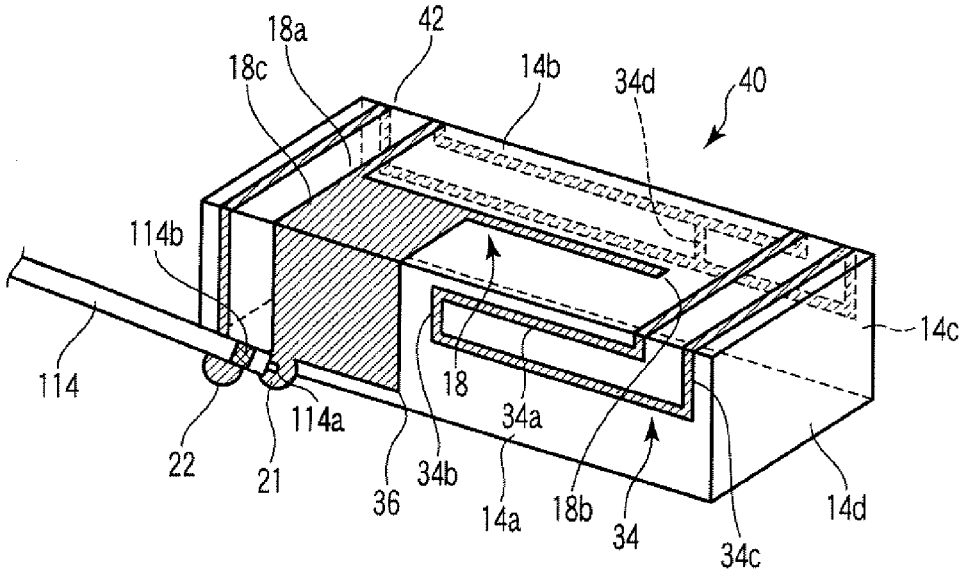
FIG. 11 is a schematic perspective view illustrating an antenna device according to a fourth embodiment of the invention.
Figure 12:
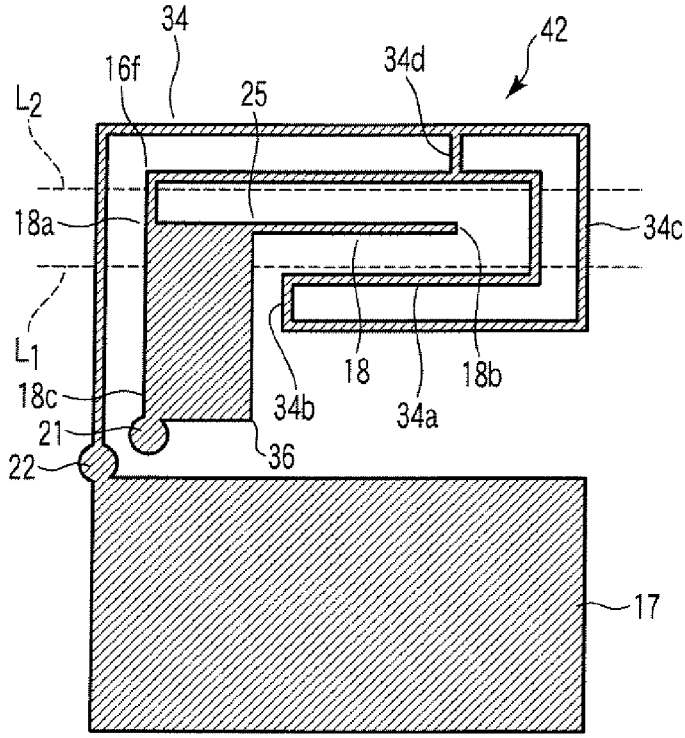
FIG. 12 is a development view of the antenna pattern of the antenna device shown in FIG. 11.

FIG. 11 is a schematic perspective view illustrating an antenna device 40 according to a fourth embodiment of the invention, which is obtained by adding, to the antenna pattern 32 of the antenna device 30 shown in FIG. 9, a rectangular portion 36 that is formed by increasing the width of the common portion 18*c*. FIG. 12 is a development view of the antenna pattern 42 of the antenna device 40. The antenna device 40 of the fourth embodiment has the same structure as the antenna device 30 of the third embodiment except that the former additionally incorporates a rectangular portion 36. Therefore, elements similar to those described in the third embodiment are denoted by corresponding reference numbers, and no detailed description will be given thereof.

In the antenna device 40, since an folded element 34 is angled at several points, it is sufficient if the antenna pattern 42 is bent along two longitudinal broken lines L1 and L2 (or along one longitudinal line) in the same direction, as in the antenna device 30 of the third embodiment. Further, in the antenna device 40 of the fourth embodiment that operates at the first and second resonance frequencies, by adding rectangular portion 36, even if the difference between the first and second resonance frequencies is relatively large, independent impedance adjustment can be easily achieved. Furthermore, in the fourth embodiment incorporating the wide rectangular portion 36, a wide resonance frequency band can be obtained in a frequency band higher than the second resonance frequency.

Figure 13:
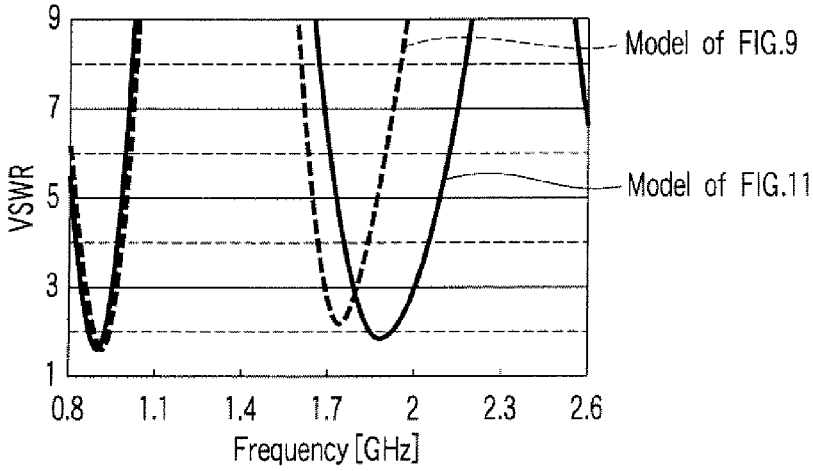
FIG. 13 is a graph illustrating the frequency characteristic simulation results of low-frequency side VSWR obtained by the antenna devices shown in FIGS. 9 and 11.
Figure 14:
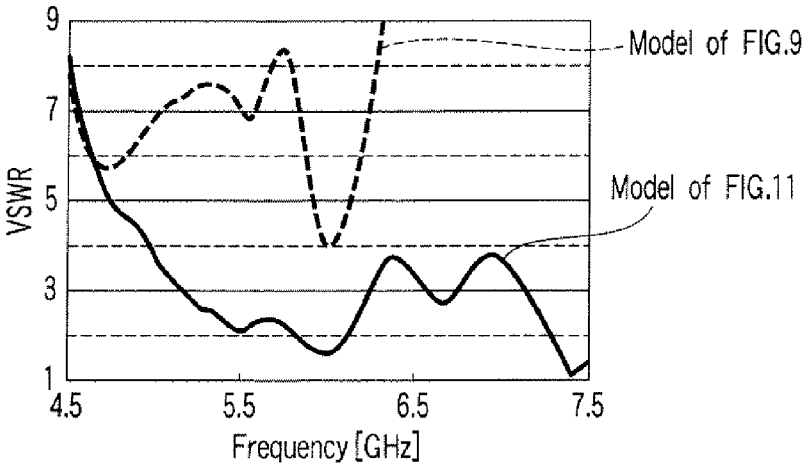
FIG. 14 is a graph illustrating the frequency characteristic simulation results of high-frequency side VSWR obtained by the antenna devices shown in FIGS. 9 and 11.

Referring then to the graphs of FIGS. 13 and 14, the resonance characteristics of the antenna device 40 will be described, compared to the antenna device 30 of the third embodiment shown in FIG. 9. FIGS. 13 and 14 show voltage standing wave ratios (VSWR) in a frequency band ranging from 0.8 [GHz] to 7.5 [GHz], obtained by simulation at the feed portion 21 of each of the antenna devices 30 and 40, using a moment method. Specifically, FIG. 13 shows the frequency characteristic of the lower band (0.8 to 2.6 [GHz]) of the VSWR, and FIG. 14 shows that of the higher band (4.5 to 7.5 [GHz]) of the VSWR.

Figure 15:
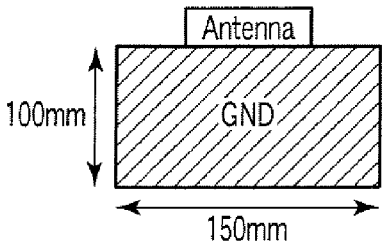
FIG. 15 is a view illustrating a ground size that serves as a simulation condition employed in the graphs of FIGS. 13 and 14.

In FIG. 13, the left-hand curves correspond to the first resonance frequency of a folded element 34, and the right-hand curves correspond to the second resonance frequency of an end free element 18. In the simulations, the ground portions of the antenna devices 30 and 40 were connected to a rectangular ground 17 with a size of 100 [mm]×150 [mm] as shown in FIG. 15.

As is evident from these graphs, in the antenna device 30 of FIG. 9, a first resonance frequency (approx. 0.9 [GHz]) and a second resonance frequency (approx. 1.7 [GHz]) are obtained, while in the antenna device 40 of FIG. 11, a first resonance frequency (approx. 0.9 [GHz]) and a second resonance frequency (approx. 1.8 [GHz]) are obtained. It is also evident from the graphs that even in a relatively wide high-frequency band (approx. 5 [GHz] to 7.5 [GHz]), VSWR<4 and hence impedance matching is made. This means that addition of the rectangular portion 36 realizes widening of a higher frequency band that has high frequency characteristic.

Figure 16:
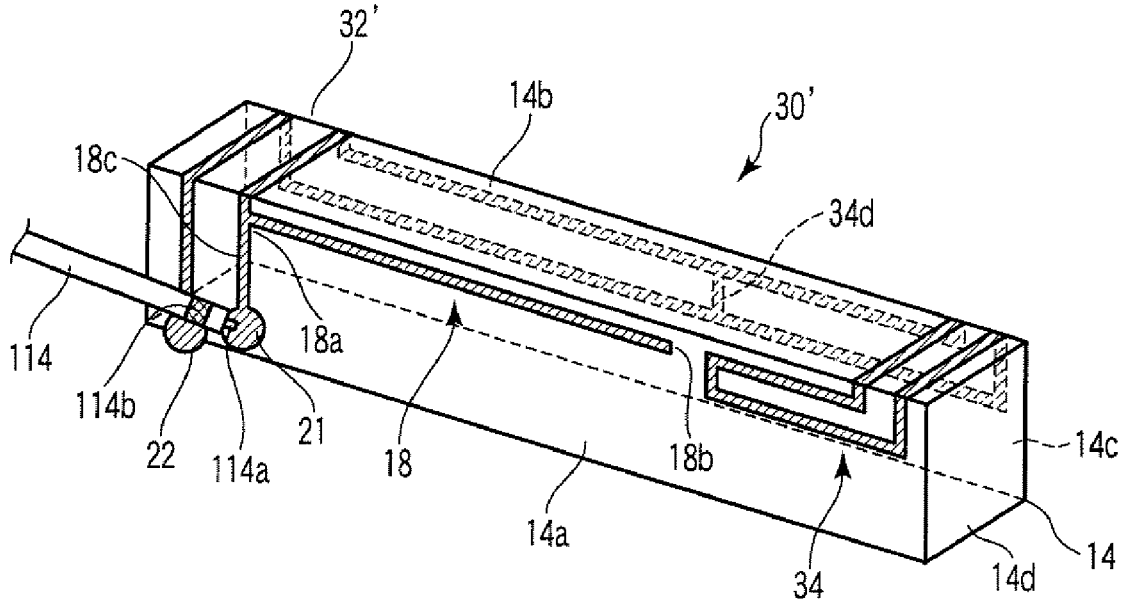
FIG. 16 is a schematic perspective view illustrating a modification of the antenna device shown in FIG. 9.
Figure 17:
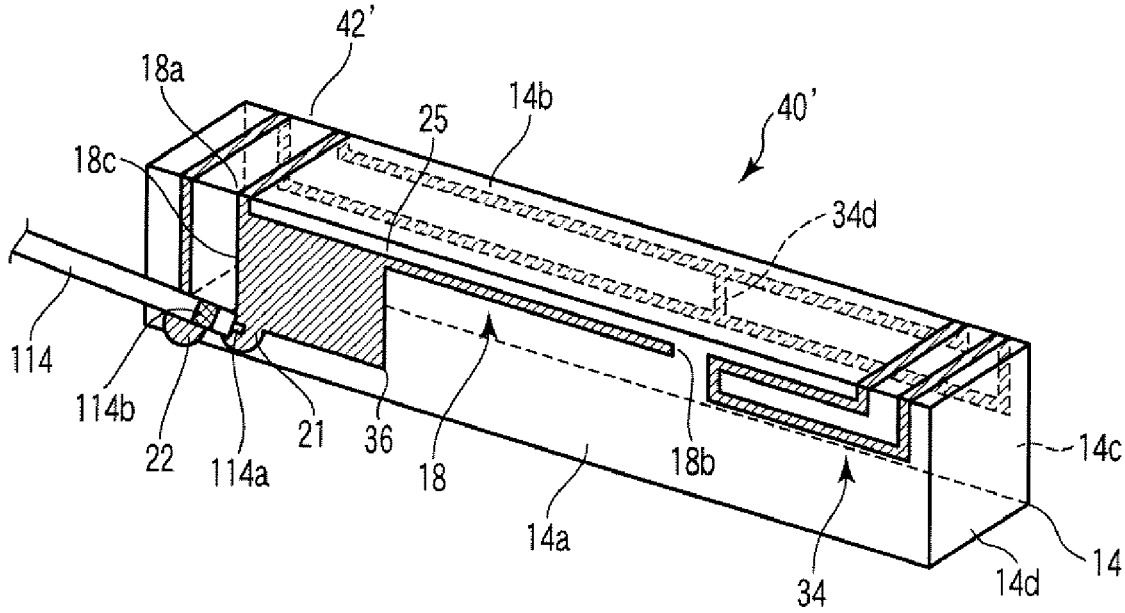
FIG. 17 is a schematic perspective view illustrating a modification of the antenna device shown in FIG. 11.

Referring then to FIGS. 16 and 17, a description will be given of a modification in which the above-mentioned antenna devices are thinned.

FIG. 16 shows a modification of the antenna device 30 of the third embodiment shown in FIG. 9. An antenna device 30' according to the modification is characterized in that the branching portion 18*a* and free end 18*b* of the second antenna 18 are provided on the first surface 14*a* of the core member 14 to thereby reduce the width of the second surface 14*b* of the core member 14. Namely, the antenna device 30' can be thinned by designing the antenna pattern 32' of the antenna device 30' as shown in FIG. 16.

FIG. 17 shows a modification of the antenna device 40 of the fourth embodiment shown in FIG. 11. An antenna device 40' according to the modification is also characterized in that the branching portion 18*a* and free end 18*b* of the second antenna 18 are provided on the first surface 14*a* of the core member 14 to thereby reduce the width of the second surface 14*b* of the core member 14. Namely, the antenna device 40' can be thinned by designing the antenna pattern 42' of the antenna device 40' as shown in FIG. 17.

In the above-mentioned antenna devices 30' and 40', the ground portion 22 is located outside the feed portion 21. Therefore, when the coaxial cable 114 connected to the feed portion 21 is led to a position away from the core member 14 of the antenna device, the external conductor 114*b* of the coaxial cable 114 can be easily connected to the ground portion 22, thereby suppressing variations in antenna characteristics due to variations in the route of the coaxial cable 114, and reducing the space required for installing the devices, as in the first to fourth embodiments.

Figure 18:
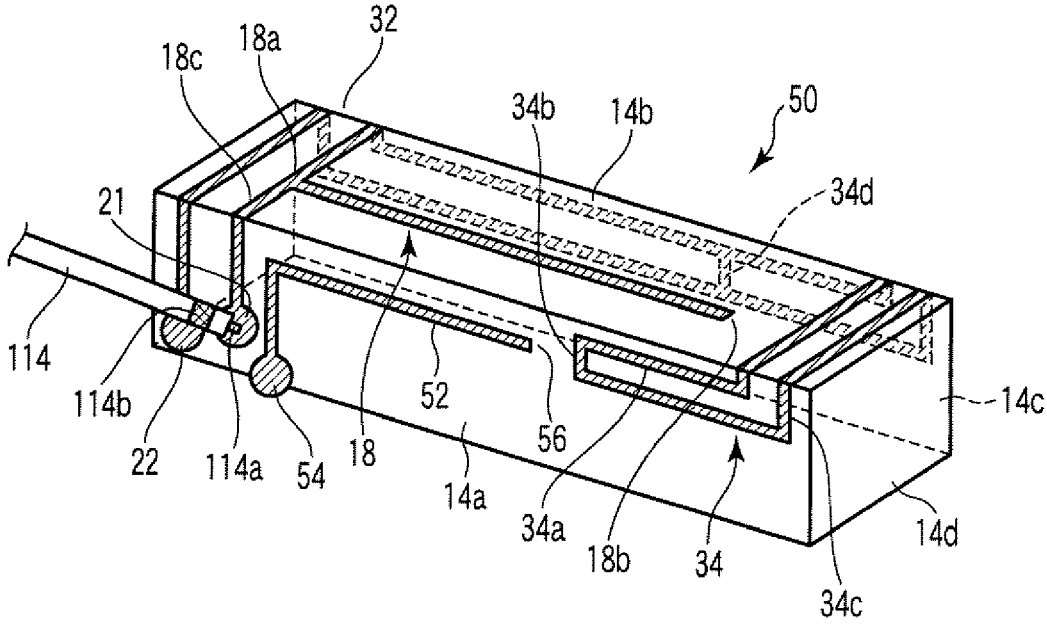
FIG. 18 is a schematic perspective view illustrating an antenna device according to a fifth embodiment of the invention.

Referring to FIG. 18, a description will be given of an antenna device 50 according to a fifth embodiment of the invention. Since the antenna device 50 has substantially the same structure as the antenna device 30 of the third embodiment except that the former additionally incorporates a parasitic element 52 located near the feed portion 21. Therefore, elements of the former similar to those of the latter are denoted by corresponding reference numbers, and no detailed description will be given thereof.

The parasitic element 52 has one end connected to a ground portion 54 provided on the first surface 14*a* of the core member 14, and the other end as a free end 56. Namely, the parasitic element 52 extends from the ground portion 54 to the free end 56 on the first surface 14*a* of the core member 14. More specifically, the parasitic element 52 is extended from the ground portion 54, located near the feed portion 21, along a short side of the first surface 14*a* in parallel with the common portion 18*c*, then angled through substantially 90°, and extended on the first surface 14*a* along a long side thereof toward the fourth surface 14*d* of the core member 14. The free end 56 of the parasitic element 52 is terminated before the folded portion 34*b* of a folded element 34. Thus, by locating the parasitic element 52 near the feed portion 21, current coupling is realized to thereby exhibit the same advantage as the third embodiment, and further, the number of resonance points that can be controlled independently is increased.

Figure 19:
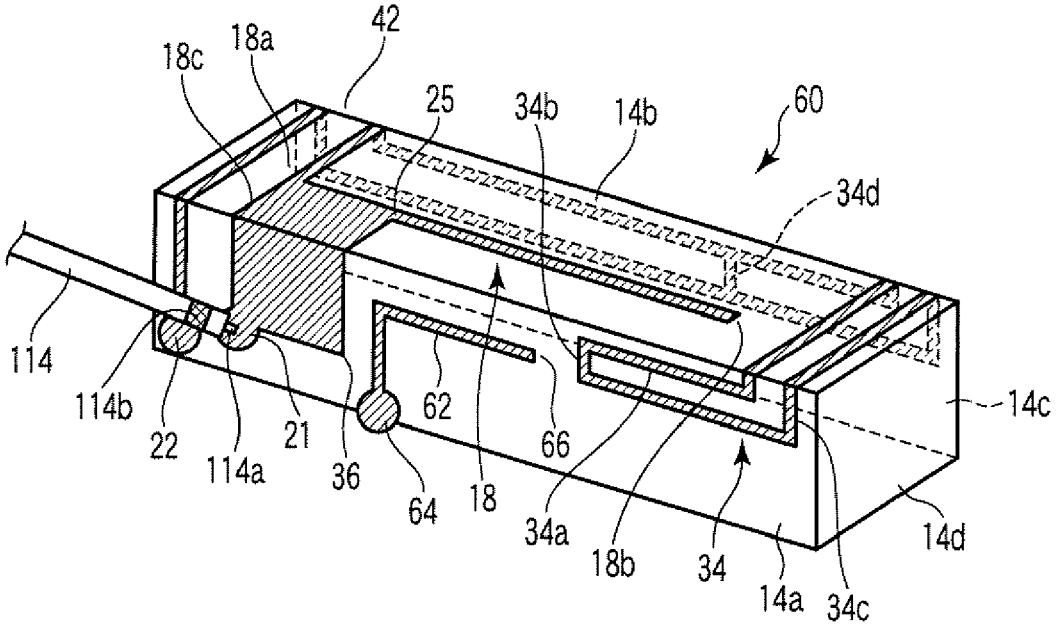
FIG. 19 is a schematic perspective view illustrating an antenna device according to a sixth embodiment of the invention.

FIG. 19 is a schematic perspective view illustrating an antenna device 60 according to a sixth embodiment of the invention. Since the antenna device 60 has substantially the same structure as the antenna device 40 of the fourth embodiment except that the former additionally incorporates a parasitic element 62 located near the rectangular portion 36. Therefore, elements of the former similar to those of the latter are denoted by corresponding reference numbers, and no detailed description will be given thereof.

The parasitic element 62 has one end connected to a ground portion 64 provided on the first surface 14*a* of the core member 14, and the other end as a free end 66. Namely, the parasitic element 62 extends from the ground portion 64 to the free end 66 on the first surface 14*a* of the core member 14. More specifically, the parasitic element 62 is extended from the ground portion 64, located near the rectangular portion 36, along the rectangular portion 36 and a short side of the first surface 14*a*, then angled through substantially 90°, and extended on the first surface 14*a* along a long side thereof toward the fourth surface 14*d* of the core member 14. The free end 66 of the parasitic element 62 is terminated before the folded portion 34*b* of a folded element 34. Thus, by locating the parasitic element 62 near the feed portion 21, current coupling is realized to thereby exhibit the same advantage as the fourth embodiment, and further, the number of resonance points that can be controlled independently is increased.

In the above-mentioned antenna devices 50 and 60, the ground portion 22 is located outside the feed portion 21. Therefore, when the coaxial cable 114 connected to the feed portion 21 is led to a position away from the core member 14 of the antenna device, the external conductor 114*b* of the coaxial cable 114 can be easily connected to the ground portion 22, thereby suppressing variations in antenna characteristics due to variations in the route of the coaxial cable 114, and reducing the space required for installing the devices, as in the first to fourth embodiments.

Figure 20:
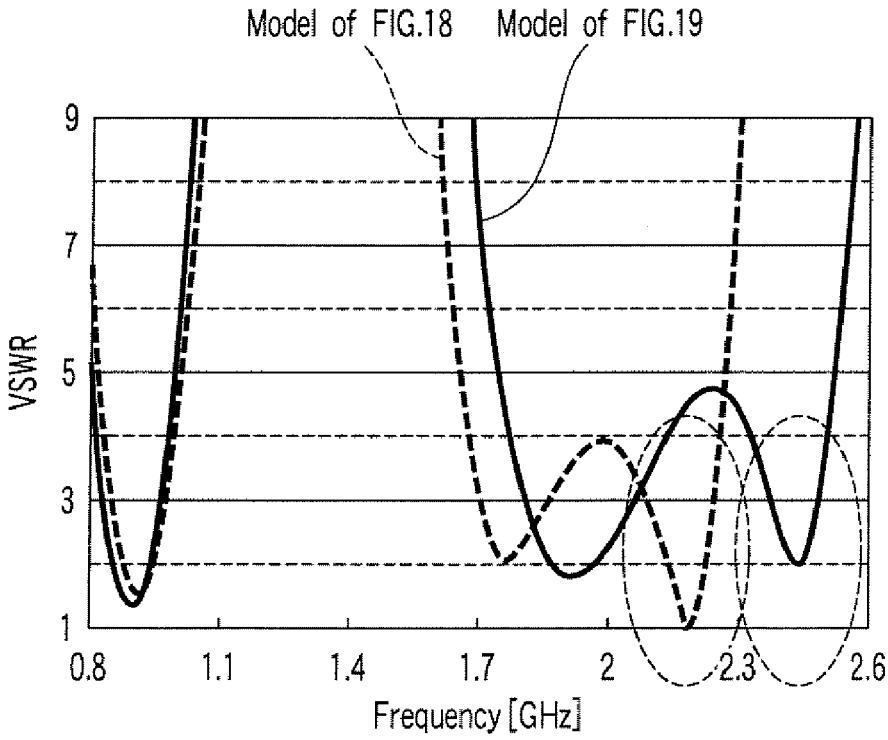
FIG. 20 is a graph illustrating the frequency characteristic simulation results of low-frequency side VSWR obtained by the antenna devices shown in FIGS. 18 and 19.

FIG. 20 shows the resonance characteristic of the antenna device 50 of the fifth embodiment shown in FIG. 18, and that of the antenna device 60 of the sixth embodiment shown in FIG. 19. A description will now only be given of changes in resonance characteristic due to the addition of the parasitic elements 52 and 62, and no description will be given of resonance characteristic in a high frequency band near 5 [GHz].

In FIG. 20, the curves indicated by the broken lines represent VSWRs in a frequency band ranging from 0.8 [GHz] to 2.6 [GHz], obtained by simulation, using a moment method, at the feed portion 21 of the antenna device 50. Further, the solid-line curves represent VSWRs in the frequency band ranging from 0.8 [GHz] to 2.6 [GHz], obtained by simulation, using the moment method, at the feed portion 21 of the antenna device 60. As is evident from FIG. 20, also in the antenna devices 50 and 60, new resonance frequencies are added with the resonance characteristic near the second resonance frequency maintained. More specifically, in the antenna device 50, a new resonance frequency is added near 2.2 [GHz]. In the antenna device 60, a new resonance frequency is added near 2.5 [GHz]. Namely, as mentioned above, addition of the parasitic elements 52 and 62 enable the antenna devices 50 and 60 to have many resonance frequencies, and a wide resonance frequency band can be formed near the second resonance frequency.

Referring to FIGS. 21 to 32, modifications of the above-described antenna devices 50 and 60 of the fifth and sixth embodiments will be described. In the modifications, elements similar to those described in the first embodiment are denoted by corresponding reference numbers, and no detailed description may be given thereof.

Figure 21:
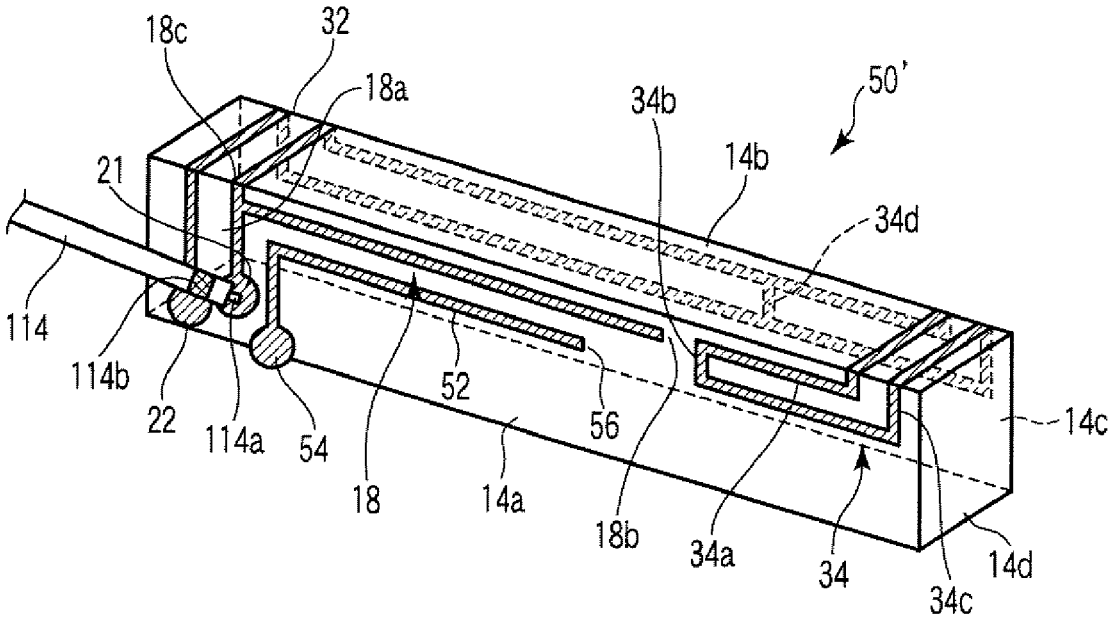
FIG. 21 is a schematic perspective view illustrating a modification of the antenna device shown in FIG. 18.

An antenna device 50', shown in FIG. 21, according to a modification of the antenna device 50 of the fifth embodiment has substantially the same structure as the antenna device 50, except that in the former, the branching portion 18*a* and free end 18*b* of the second antenna 18 are provided on the first surface 14*a* of the core member 14. By thus laying out the antenna pattern 32, the antenna device 50' can be thinned, in addition to the above-mentioned advantage of the antenna device 50.

Figure 22:
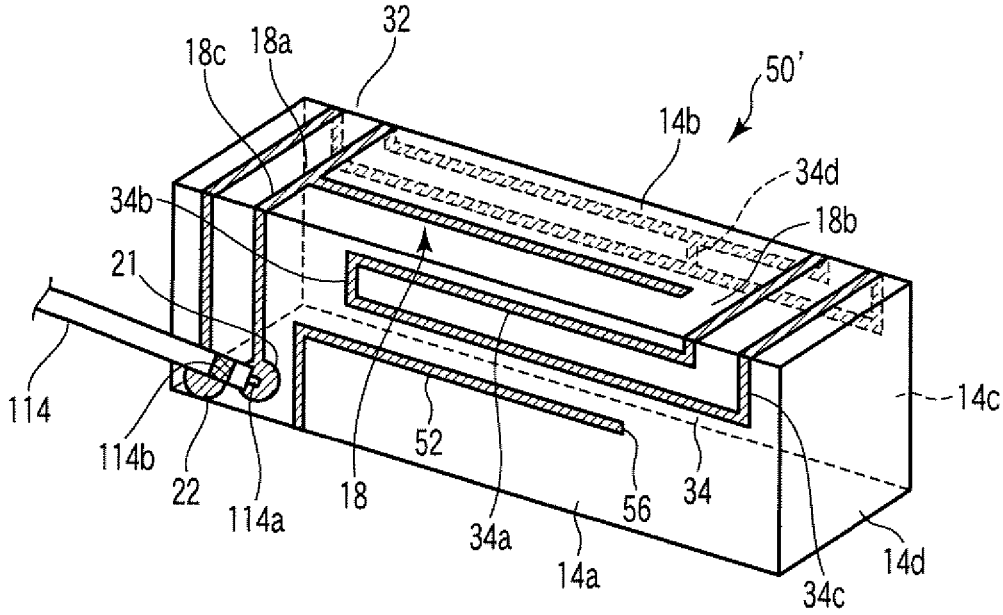
FIG. 22 is a schematic perspective view illustrating another modification of the antenna device shown in FIG. 18.

An antenna device 50', shown in FIG. 22, according to another modification of the antenna device 50 has substantially the same structure as the antenna device 50, except that in the former, the antenna pattern 32 is routed such that the parasitic element 52 and a folded element 34 extend on the first surface 14*a* of the core member 14 in parallel with each other along a long side of the first surface 14*a*. By thus laying out the antenna pattern 32, the longitudinal size of the antenna device 50' can be reduced, in addition to the above-mentioned advantage of the antenna device 50.

Figure 23:
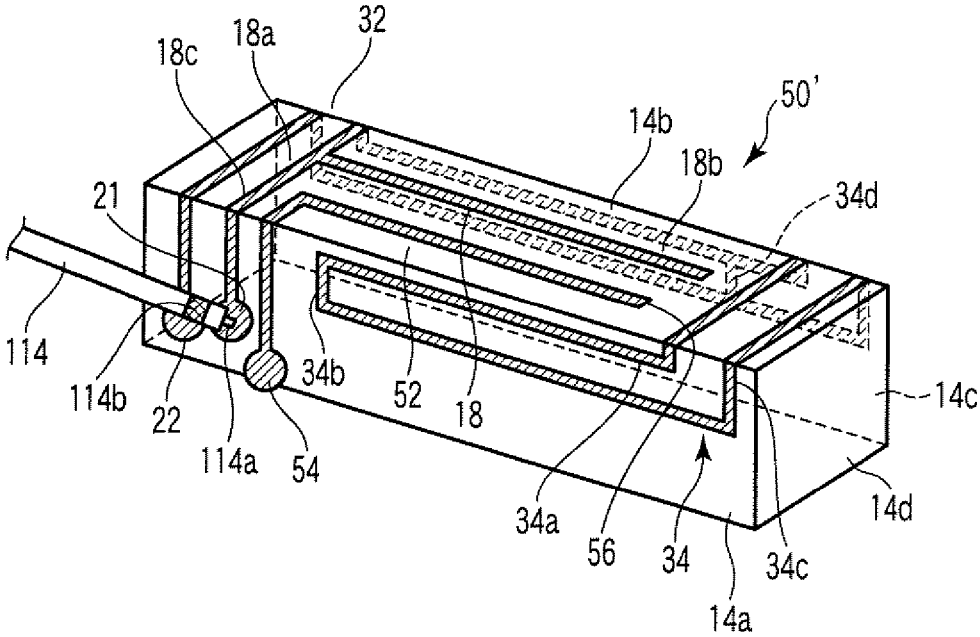
FIG. 23 is a schematic perspective view illustrating yet another modification of the antenna device shown in FIG. 18.

An antenna device 50', shown in FIG. 23, according to yet another modification of the antenna device 50 has substantially the same structure as the modification of FIG. 22, except that in the former, the parasitic element 52 is extended from the ground portion 54 to the second surface 14*b* of the core member 14 via the first surface 14*a*, then bent at substantially right angles, and then extended such that the portion of the parasitic element 52 ranging from the angled point to the free end 56 is substantially parallel with an end-free element 18. By thus laying out the antenna pattern 32, the width of the antenna device 50' can be reduced.

Figure 24:
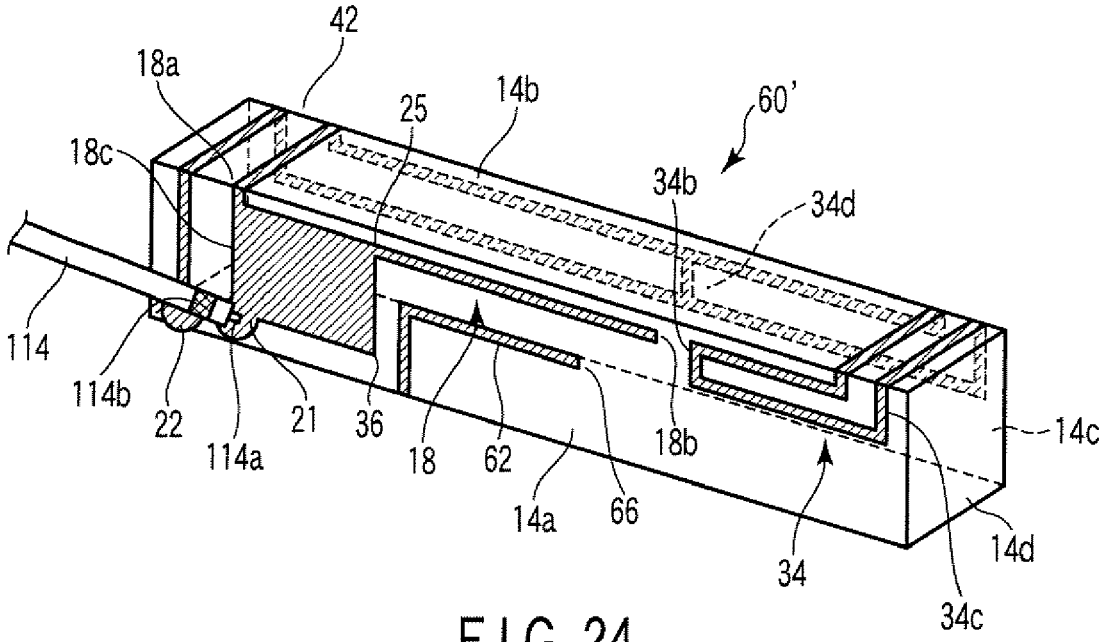
FIG. 24 is a schematic perspective view illustrating a modification of the antenna device shown in FIG. 19.

An antenna device 60', shown in FIG. 24, according to a modification of the antenna device 60 of the sixth embodiment has substantially the same structure as the antenna device 60, except that in the former, the rectangular portion 36 and the free end 18*b* of an end-free element 18 are provided on the first surface 14*a* of the core member 14. By thus laying out the antenna pattern 42, the antenna device 60' can be thinned, in addition to the above-mentioned advantage of the antenna device 60.

Figure 25:
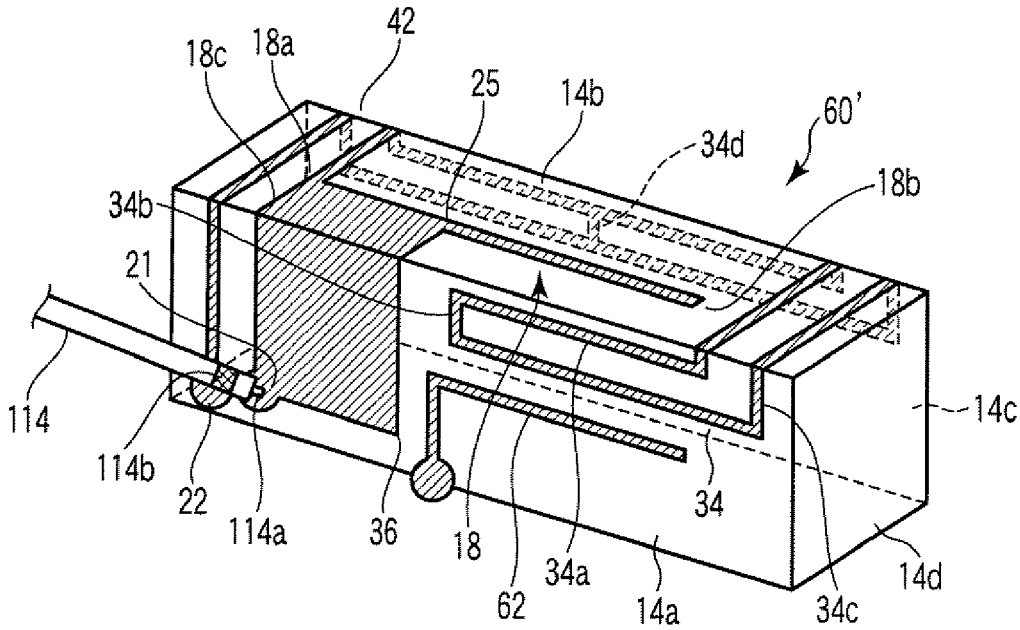
FIG. 25 is a schematic perspective view illustrating another modification of the antenna device shown in FIG. 19.

An antenna device 60', shown in FIG. 25, according to another modification of the antenna device 60 has substantially the same structure as the antenna device 60, except that in the former, the antenna pattern 42 is routed such that the parasitic element 62 and a folded element 34 extend on the first surface 14*a* of the core member 14 in parallel with each other along a long side of the first surface 14*a*. By thus laying out the antenna pattern 42, the longitudinal size of the antenna device 60' can be reduced, in addition to the above-mentioned advantage of the antenna device 60.

Figure 26:
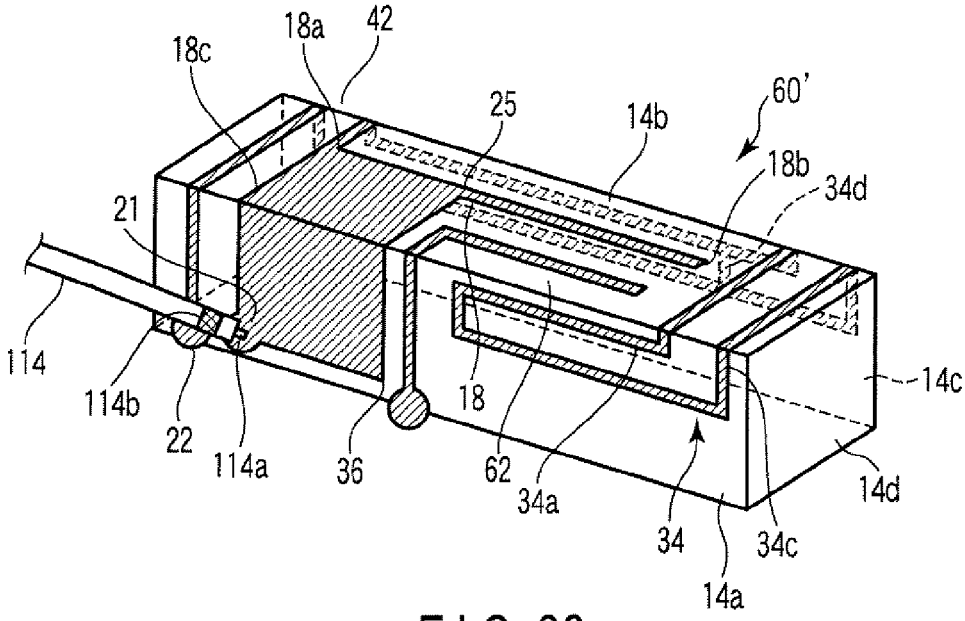
FIG. 26 is a schematic perspective view illustrating yet another modification of the antenna device shown in FIG. 19.

An antenna device 60', shown in FIG. 26, according to yet another modification of the antenna device 60 has substantially the same structure as the modification of FIG. 25, except that in the former, the parasitic element 62 is extended from the ground portion 64 to the second surface 14*b* of the core member 14 via the first surface 14*a*, then bent at substantially right angles, and then extended such that the portion of the parasitic element 62 ranging from the angled point to the free end 66 is substantially parallel with an end-free element 18. By thus laying out the antenna pattern 42, the width of the antenna device 60' can be reduced.

Figure 27:
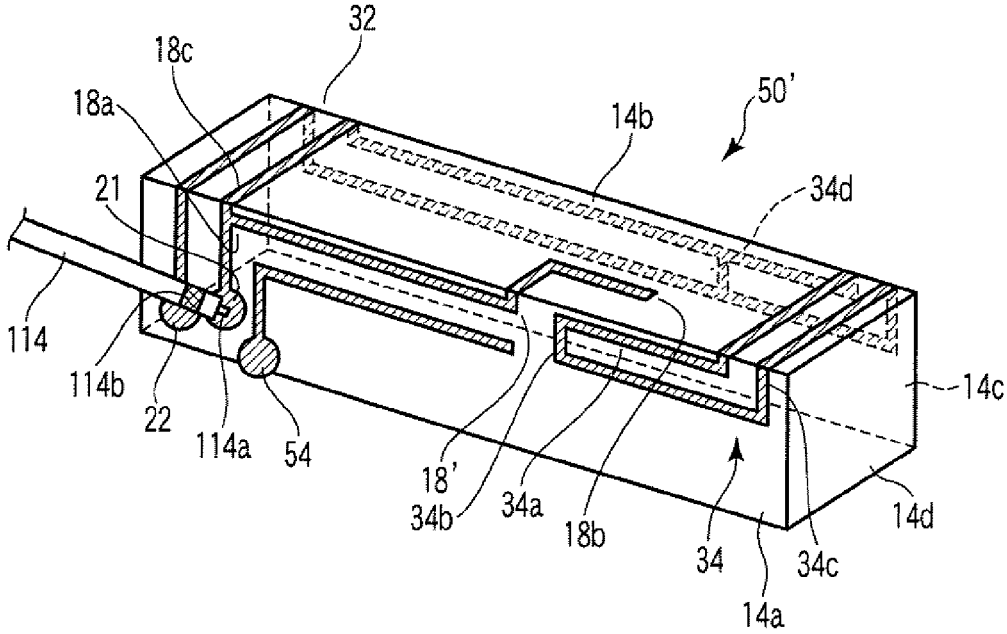
FIG. 27 is a schematic perspective view illustrating a modification of the antenna device shown in FIG. 18.

An antenna device 50', shown in FIG. 27, according to a further modification of the antenna device 50 has substantially the same structure as the antenna device 50, except that in the former, an end-free element 18' is angled at several points so that the branching portion 18*a* of an end-free element 18' is located on the first surface 14*a* of the core member 14, and the free end 18*b* of an end-free element 18' is located on the second surface 14*b*. By thus laying out the antenna pattern 32, the antenna device 50' can provide the same advantage as that of the antenna device 50.

Figure 28:
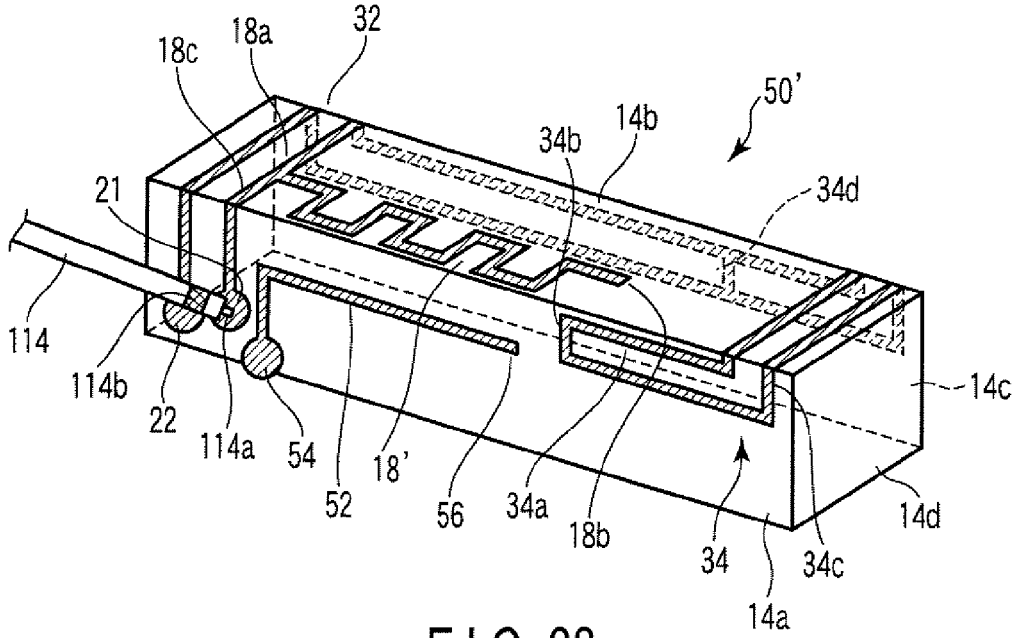
FIG. 28 is a schematic perspective view illustrating a further modification of the antenna device shown in FIG. 18.

An antenna device 50', shown in FIG. 28, according to yet further modification of the antenna device 50 has substantially the same structure as the antenna device 50, except that in the former, the portion of an end-free element 18' extending from the branching portion 18*a* to the free end 18*b* is formed to meander. By thus forming part of an end-free element 18' to meander, the second antenna 18' can be provided in a small space.

Figure 29:
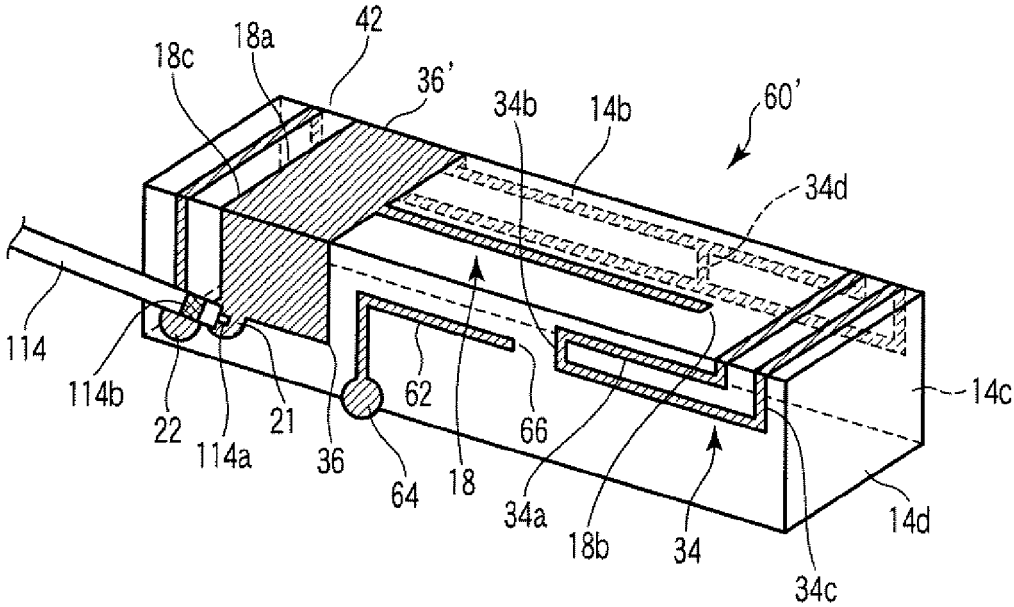
FIG. 29 is a schematic perspective view illustrating another modification of the antenna device shown in FIG. 19.
Figure 30:
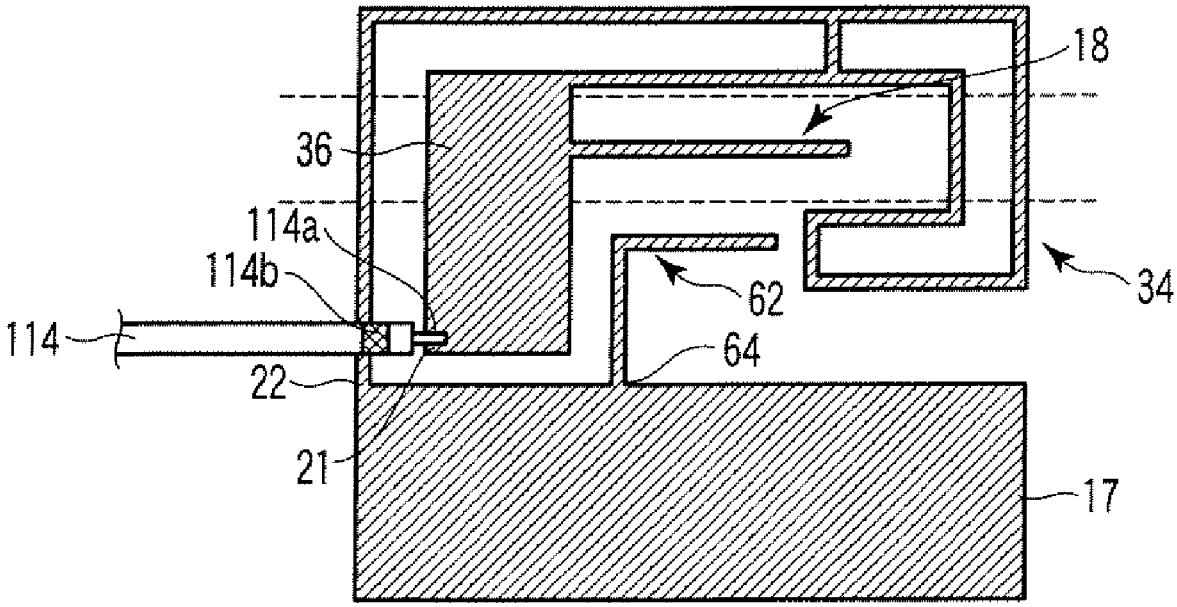
FIG. 30 is a development view of the antenna pattern of the antenna device shown in FIG. 29.

An antenna device 60', shown in FIG. 29, according to yet another modification of the antenna device 60 has substantially the same structure as the antenna device 60, except that the former incorporates a rectangular portion 36' obtained by increasing the area of the common portion 18*c* of an end-free element 18 over the branching portion 18*a* up to the middle portion of the approach route portion 34*a* of a folded element 34. FIG. 30 is a development view of the antenna pattern 42 of the antenna device 60'. By widening the area of the rectangular portion 36', the band of the first resonance frequency can be further widened.

Figure 31:
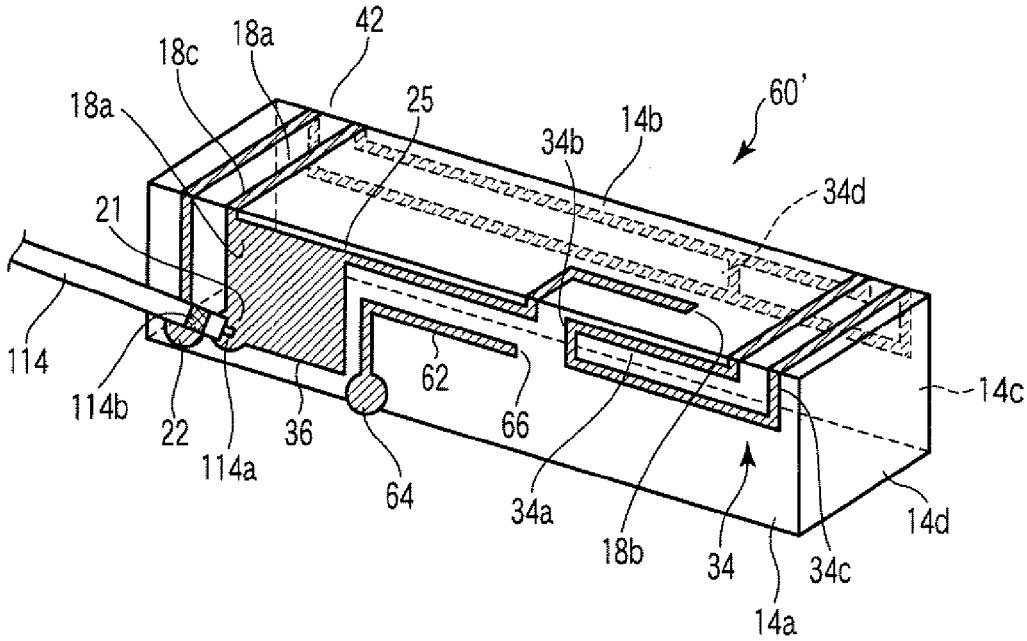
FIG. 31 is a schematic perspective view illustrating a further modification of the antenna device shown in FIG. 19.

An antenna device 60', shown in FIG. 31, according to a further modification of the antenna device 60 has substantially the same structure as the antenna device 60, except that in the former, an end-free element 18' is angled at several points so that the branching portion 18*a* of an end-free element 18' and the rectangular portion 36 are located on the first surface 14*a* of the core member 14, and the free end 18*b* of an end-free antenna 18' is located on the second surface 14*b*. By thus laying out the antenna pattern 42, the antenna device 60' can provide the same advantage as that of the antenna device 60.

Figure 32:
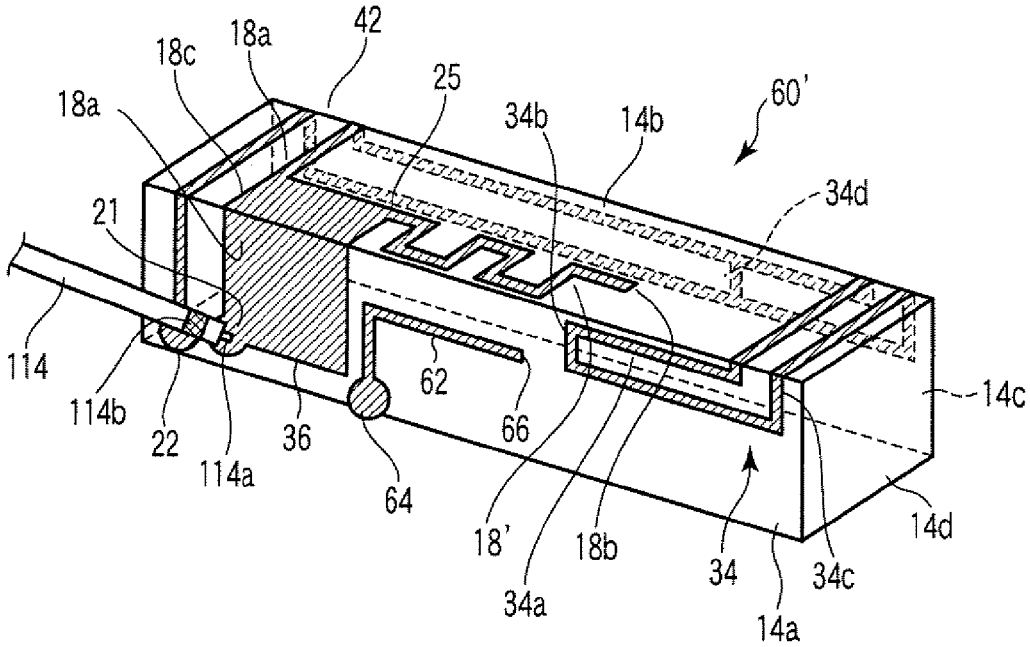
FIG. 32 is a schematic perspective view illustrating yet further modification of the antenna device shown in FIG. 19.

An antenna device 60', shown in FIG. 32, according to a further modification of the antenna device 60 has substantially the same structure as the antenna device 60, except that in the former, the portion of an end-free element 18' extending from the rectangular portion 36 to the free end 18*b* is formed to meander. By thus forming part of an end-free element 18' to meander, an end-free element 18' can be provided in a small space.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

For instance, although in the above-described embodiments and modifications, the antenna pattern is wound around the core member 14, the invention is not limited to this. The core member 14 is not indispensable to the invention.

The invention claimed is:

1. An antenna device operable at a first resonance frequency and a second resonance frequency, comprising:

a folded element including an approach route portion extending from a feed portion to a folded portion via at least one angled portion, a return route portion extending from the folded portion to a ground portion in substantially parallel with the approach route portion, and a short-circuiting portion short-circuiting the approach and return route portions, a length of a route ranging from the feed portion to the ground portion via the folded portion being substantially equal to half a wavelength corresponding to the first resonance frequency, a distance between the feed portion and the ground portion being equal to or less than one fifth of the wavelength corresponding to the first resonance frequency; and an end-free element branching from the folded element between the feed portion and the angled portion, and including a free end, a length of a route ranging from the feed portion to the free end via a branching portion being substantially equal to one quarter of a wavelength corresponding to the second resonance frequency, wherein the feed portion is located close to one end of the antenna device, and the ground portion is located closer to the one end than the feed portion.

2. The antenna device according to claim 1, wherein the short-circuiting portion is provided at a preset position such that a length of a route ranging from the feed portion to the ground portion via the short-circuiting portion is substantially equal to half the wavelength corresponding to the second resonance frequency.

3. The antenna device according to claim 1, further comprising a feed-side partial element formed by increasing, toward the free end of the end-free element, a width of a portion of the folded element ranging from the feed portion to the branching portion.

4. The antenna device according to claim 3, wherein a length of a route ranging from the feed portion to a branching portion between the end-free element and the feed-side partial element along the feed-side partial element is substantially equal to one quarter of a wavelength corresponding to a third resonance frequency, the antenna device being also operable at the third resonance frequency.

5. The antenna device according to claim 4, wherein a distance between the feed-side partial element and a ground area is not more than 1/20 of a wavelength corresponding to the third resonance frequency.

6. The antenna device according to claim 3, wherein a width of the feed-side partial element is substantially equal to one quarter of a wavelength corresponding to a fourth resonance frequency, the antenna device being also operable at the fourth resonance frequency.

7. The antenna device according to claim 3, further comprising a parasitic element located near the feed-side partial element and having one end grounded.

8. The antenna device according to claim 1, wherein:

the approach route portion is extended from the feed portion to the angled portion, bent at the angled portion and extended in parallel with the end-free element by a distance greater than a length of the end-free element, and again bent around the free end of the end-free element to the folded portion; and the return route portion is extended from the folded portion to the ground portion bent along the entire approach route portion.

9. The antenna device according to claim 8, wherein the folded element and the end-free element are formed on a flexible wiring board, and the flexible wiring board is bent at least along a long side thereof.

10. The antenna device according to claim 1, further comprising a parasitic element located near the feed portion and having one end grounded.

11. The antenna device according to claim 1, wherein the feed portion is connected to a feed cable, and the feed cable is led toward the ground portion and connected near the ground portion.

12. An electronic apparatus comprising:

a display housing containing a substantially rectangular display panel;

at least one antenna device located along an edge of the display housing, the at least one antenna device provided with a folded element that includes an approach route portion extending from a feed portion to a folded portion via at least one angled portion, a return route portion extending from the folded portion to a ground portion in substantially parallel with the approach route portion, and a short-circuiting portion short-circuiting the approach and return route portions, a length of a route ranging from the feed portion to the ground portion via the folded portion being substantially equal to half a wavelength corresponding to the first resonance frequency, a distance between the feed portion and the ground portion being equal to or less than one fifth of the wavelength corresponding to the first resonance frequency, and an end-free element branching from the folded element between the feed portion and the angled portion, and including a free end, a length of a route ranging from the feed portion to the free end via a branching portion being substantially equal to one quarter of a wavelength corresponding to the second resonance frequency, the feed portion being located close to one end of the antenna device, and the ground portion is located closer to the one end than the feed portion;

a feed cable connected to the feed portion of the antenna device, led from the feed portion toward the ground portion, and connected near the ground portion; and a radio communication module connected to the antenna device via the feed cable.

13. The electronic apparatus according to claim 12, wherein the short-circuiting portion is provided at a preset position such that a length of a route ranging from the feed portion to the ground portion via the short-circuiting portion is substantially equal to half the wavelength corresponding to the second resonance frequency.

14. The electronic apparatus according to claim 12, further comprising a feed-side partial element formed by increasing, toward the free end of the end-free element, a width of a portion of the folded element ranging from the feed portion to the branching portion.

15. The electronic apparatus according to claim 14, wherein a length of a route ranging from the feed portion to a branching portion between the end-free element and the feed-side partial element along the feed-side partial element is substantially equal to one quarter of a wavelength corresponding to a third resonance frequency, the antenna device being also operable at the third resonance frequency.

16. The electronic apparatus according to claim 15, wherein a distance between the feed-side partial element and a ground area is not more than 1/20 of a wavelength corresponding to the third resonance frequency.

17. The electronic apparatus according to claim 14, wherein a width of the feed-side partial element is substantially equal to one quarter of a wavelength corresponding to a fourth resonance frequency, the antenna device being also operable at the fourth resonance frequency.

18. The electronic apparatus according to claim 14, further comprising a parasitic element located near the feed-side partial element and having one end grounded.

19. The electronic apparatus according to claim 12, further comprising a parasitic element located near the feed portion and having one end grounded.

20. An electronic apparatus comprising:

a housing;

a feed cable; and an antenna device arranged at a peripheral portion inside the housing and coupled to the feed cable that is arranged along the peripheral portion, the antenna device comprising a feed portion coupled to the feed cable, a ground portion provided adjacent in an extending direction of the cable from the feed portion to ground the cable, a folded element including an approach route portion extending from the feed portion to a folded portion and a return route extending from the folded portion to the ground portion in parallel with the approach route, an end-free element branching from the approach route, and a feed-side partial element formed by increasing a width of the approach route portion of the folded element, from the feed portion to a branch position of the end-free element, and coupled to the end-free element to fill a gap between the feed-side partial element and the end-free element.

* * * * *